US011920409B2

(12) United States Patent
Russell et al.

(10) Patent No.: US 11,920,409 B2
(45) Date of Patent: Mar. 5, 2024

(54) CUTTING ELEMENTS, EARTH-BORING TOOLS INCLUDING THE CUTTING ELEMENTS, AND METHODS OF FORMING THE EARTH-BORING TOOLS

(71) Applicant: Baker Hughes Oilfield Operations LLC, Houston, TX (US)

(72) Inventors: Steven Craig Russell, The Woodlands, TX (US); Gregory L. Ricks, Spring, TX (US); Stephen Duffy, Spring, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 17/810,802

(22) Filed: Jul. 5, 2022

(65) Prior Publication Data

US 2024/0011357 A1 Jan. 11, 2024

(51) Int. Cl.
*E21B 10/567* (2006.01)
*E21B 10/55* (2006.01)

(52) U.S. Cl.
CPC ..... *E21B 10/5673* (2013.01); *E21B 10/55* (2013.01)

(58) Field of Classification Search
CPC .... E21B 10/5673; E21B 10/55; E21B 10/567; E21B 10/5735; E21B 10/5671; E21B 10/56; B22F 2005/001
See application file for complete search history.

(56) References Cited

U.S. PATENT DOCUMENTS

| | | | |
|---|---|---|---|
| 4,109,737 | A | 8/1978 | Bovenkerk |
| 4,529,048 | A | 7/1985 | Hall |
| 4,570,726 | A | 2/1986 | Hall |
| 4,593,777 | A | 6/1986 | Barr |
| 4,872,520 | A | 10/1989 | Nelson |
| 4,987,800 | A | 1/1991 | Gasan et al. |
| 4,989,578 | A | 2/1991 | Lebourg |
| 5,054,246 | A | 10/1991 | Phaal et al. |
| 5,172,778 | A | 12/1992 | Tibbitts et al. |
| 5,333,699 | A | 8/1994 | Thigpen et al. |
| 5,377,773 | A | 1/1995 | Tibbitts |
| 5,437,343 | A | 8/1995 | Cooley et al. |
| 5,449,048 | A | 9/1995 | Thigpen et al. |

(Continued)

FOREIGN PATENT DOCUMENTS

| | | | |
|---|---|---|---|
| CN | 205259954 | U | 3/2013 |
| CN | 205778558 | U | 12/2016 |

(Continued)

*Primary Examiner* — Daniel P Stephenson
(74) *Attorney, Agent, or Firm* — TraskBritt

(57) ABSTRACT

A cutting element includes a substrate and a cutting table secure to the substrate. The cutting table includes a first surface, a cutting surface, a first transition surface, and a second transition surface. The cutting surface at least substantially surrounds an outer boundary of the first surface and is angled relative to a longitudinal centerline of the cutting table. The first and second transition surfaces are between the cutting surface and an outer lateral edge of the cutting table. The first and second transition surfaces are oriented at a first angle and a second different angle, respectively, relative to the longitudinal centerline of the cutting table. An earth-boring tool and method of forming an earth-boring tool are also described.

16 Claims, 11 Drawing Sheets

(56) References Cited

U.S. PATENT DOCUMENTS 5,460,233 A * 10/1995 Meany ..... E21B 10/5673 175/428
5,467,836 A 11/1995 Grimes et al.
5,499,688 A 3/1996 Dennis
5,709,279 A 1/1998 Dennis
5,871,060 A 2/1999 Jensen et al.
5,881,830 A 3/1999 Cooley
6,045,440 A 4/2000 Johnson et al.
6,065,554 A 5/2000 Taylor et al.
6,196,340 B1 3/2001 Jensen et al.
6,202,770 B1 3/2001 Tibbitts
6,244,365 B1 6/2001 Southland
6,447,560 B2 * 9/2002 Jensen ..... B22F 7/06 51/293
6,481,952 B2 11/2002 Deutschle et al.
6,510,910 B2 1/2003 Eyre et al.
6,527,069 B1 3/2003 Meiners et al.
6,550,556 B2 4/2003 Middlemiss et al.
6,672,406 B2 1/2004 Beuershausen
6,929,079 B2 8/2005 McDonough et al.
6,935,444 B2 8/2005 Lund et al.
7,363,992 B2 4/2008 Stowe et al.
7,475,744 B2 1/2009 Pope
7,726,420 B2 6/2010 Shen et al.
7,740,090 B2 6/2010 Shen et al.
7,757,785 B2 7/2010 Zhang et al.
7,798,257 B2 9/2010 Shen et al.
8,037,951 B2 10/2011 Shen et al.
8,087,478 B2 1/2012 Patel
8,113,303 B2 2/2012 Zhang et al.
8,191,656 B2 6/2012 Dourfaye et al.
8,353,370 B2 1/2013 Bellin et al.
8,360,175 B2 1/2013 Fan et al.
8,499,860 B2 8/2013 Shen et al.
8,684,112 B2 4/2014 DiGiovanni
8,783,387 B2 7/2014 Durairajan et al.
8,833,492 B2 9/2014 Durairajan et al.
8,851,206 B2 10/2014 Patel
9,062,505 B2 6/2015 Chapman et al.
9,103,174 B2 8/2015 DiGiovanni
9,145,743 B2 9/2015 Shen et al.
RE45,748 E 10/2015 Zhang et al.
9,243,452 B2 1/2016 DiGiovanni et al.
9,376,867 B2 6/2016 DiGiovanni et al.
9,388,639 B2 7/2016 Patel et al.
9,404,310 B1 8/2016 Sani et al.
9,428,966 B2 8/2016 Patel et al.
9,441,422 B2 9/2016 DiSantis
9,598,909 B2 3/2017 Patel
9,650,837 B2 5/2017 Patel et al.
9,702,198 B1 7/2017 Topham
9,845,642 B2 12/2017 Stockey
10,017,994 B2 7/2018 Von et al.
10,022,840 B1 7/2018 Miess
10,125,552 B2 11/2018 Zhao et al.
10,240,399 B2 3/2019 Rahmani
10,287,825 B2 5/2019 Chen et al.
10,309,156 B2 6/2019 Azar et al.
10,378,289 B2 8/2019 Stockey
10,400,517 B2 9/2019 Borge
10,465,447 B2 11/2019 Stockey et al.
10,480,253 B2 11/2019 Vempati et al.
10,550,644 B2 2/2020 Drews et al.
10,570,668 B2 2/2020 Izbinski et al.
10,577,870 B2 3/2020 Izbinski et al.
10,605,010 B2 3/2020 De Maindreville et al.
10,753,157 B2 8/2020 Rahmani
10,794,118 B2 10/2020 Azar et al.
10,801,268 B2 10/2020 Rahmani et al.
10,907,416 B2 2/2021 Cheng et al.
11,035,177 B2 6/2021 Dubose et al.
11,060,356 B2 7/2021 Cuillier De Maindreville et al.
11,091,960 B2 8/2021 Zhang et al.
11,098,532 B2 8/2021 Gan et al.
11,208,849 B2 12/2021 Rahmani et al.
11,255,129 B2 2/2022 Dubose et al.
2001/0030063 A1 10/2001 Dykstra et al.
2003/0158018 A1 8/2003 Giannelli et al.
2004/0097532 A1 5/2004 Jesudason et al.
2004/0163851 A1 8/2004 McDonough et al.
2005/0269139 A1 12/2005 Shen et al.
2006/0157286 A1 7/2006 Pope
2006/0210364 A1 9/2006 Bellmann et al.
2006/0219439 A1 10/2006 Shen et al.
2007/0079995 A1 4/2007 McClain et al.
2008/0190666 A1 8/2008 Gatell
2008/0205804 A1 8/2008 Jeng
2008/0236900 A1 10/2008 Cooley et al.
2009/0057031 A1 3/2009 Patel et al.
2010/0059287 A1 3/2010 Durairajan et al.
2010/0084198 A1 4/2010 Durairajan et al.
2010/0288564 A1 11/2010 Dovalina et al.
2010/0300765 A1 12/2010 Zhang et al.
2010/0307829 A1 12/2010 Patel
2011/0031030 A1 2/2011 Shen et al.
2011/0031031 A1 2/2011 Vempati et al.
2011/0088950 A1 4/2011 Scott et al.
2011/0155472 A1 6/2011 Lyons et al.
2011/0171414 A1 7/2011 Sreshta et al.
2011/0259642 A1 10/2011 DiGiovanni et al.
2011/0286810 A1 11/2011 Lancaster et al.
2012/0247834 A1 10/2012 Buxbaum et al.
2012/0325563 A1 12/2012 Scott et al.
2013/0068534 A1 3/2013 DiGiovanni et al.
2013/0068537 A1 3/2013 DiGiovanni
2013/0068538 A1 3/2013 DiGiovanni et al.
2013/0292188 A1 11/2013 Bilen et al.
2013/0306377 A1 11/2013 DiGiovanni et al.
2014/0041948 A1 2/2014 Shen et al.
2014/0048340 A1 2/2014 DiGiovanni et al.
2014/0238753 A1 8/2014 Nelms et al.
2014/0246253 A1 9/2014 Patel et al.
2014/0318873 A1 10/2014 Patel et al.
2014/0366456 A1 * 12/2014 Chapman ..... B23K 26/364 51/307
2015/0047913 A1 2/2015 Durairajan et al.
2015/0259986 A1 9/2015 Stockey
2015/0259988 A1 9/2015 Chen et al.
2015/0285007 A1 10/2015 Stockey et al.
2016/0069140 A1 3/2016 Patel et al.
2016/0108678 A1 4/2016 Von et al.
2016/0265285 A1 9/2016 Stockey et al.
2017/0175452 A1 6/2017 Vempati et al.
2017/0234078 A1 8/2017 Patel et al.
2018/0148978 A1 5/2018 Chen
2018/0274303 A1 9/2018 Song et al.
2018/0320450 A1 11/2018 Borge et al.
2018/0355672 A1 12/2018 De et al.
2019/0040689 A1 2/2019 Liang et al.
2019/0071933 A1 3/2019 Gan et al.
2019/0084087 A1 3/2019 Chapman et al.
2019/0106943 A1 4/2019 Tilleman et al.
2019/0112877 A1 4/2019 Gan et al.
2019/0309578 A1 10/2019 Borge
2019/0376346 A1 12/2019 Vijayabalan
2020/0032588 A1 1/2020 Izbinski et al.
2020/0032589 A1 1/2020 Izbinski et al.
2020/0157890 A1 5/2020 Cuillier et al.
2020/0224501 A1 7/2020 Dubose et al.
2020/0340303 A1 10/2020 Cheng et al.
2021/0131190 A1 * 5/2021 Rahmani ..... E21B 10/42
2021/0156202 A1 5/2021 Gan et al.
2021/0172258 A1 6/2021 Graham et al.
2021/0180409 A1 6/2021 Davila et al.
2021/0215003 A1 7/2021 Mahajan et al.
2021/0277722 A1 9/2021 Liu et al.
2021/0370419 A1 12/2021 Yu et al.
2021/0372203 A1 12/2021 Eyre et al.
2021/0381318 A1 12/2021 Gan et al.
2022/0003046 A1 1/2022 Yu et al.
2022/0074271 A1 3/2022 Rahmani et al.

(56) References Cited

U.S. PATENT DOCUMENTS

| | | | | |
|---|---|---|---|---|
| 2022/0112773 | A1 | 4/2022 | Chen et al. | |
| 2022/0381092 | A1 * | 12/2022 | Gan | E21B 10/5673 |

FOREIGN PATENT DOCUMENTS

| | | | | |
|---|---|---|---|---|
| EP | 0121083 | A1 | 10/1984 | |
| EP | 0572761 | A1 | 12/1993 | |
| EP | 0893572 | B1 | 12/2003 | |
| EP | 0841463 | B1 | 3/2004 | |
| GB | 2369841 | | 12/2004 | |
| JP | 11-060667 | A | 3/1999 | |
| JP | 2008-291222 | A | 12/2008 | |
| JP | 5315838 | B2 | 10/2013 | |
| WO | 97/30263 | A1 | 8/1997 | |
| WO | 00/48789 | A1 | 8/2000 | |
| WO | 2004/007901 | A1 | 1/2004 | |
| WO | 2004/007907 | A1 | 1/2004 | |
| WO | 2008/102324 | A1 | 8/2008 | |
| WO | 2013/040123 | A1 | 3/2013 | |
| WO | 2016/004136 | A1 | 3/2016 | |
| WO | 2016/044136 | A1 | 3/2016 | |
| WO | 2018/231343 | A1 | 12/2018 | |
| WO | WO-2020055882 | A1 * | 3/2020 | E21B 10/43 |
| WO | 2020/102016 | A1 | 5/2020 | |
| WO | 2020/131421 | | 6/2020 | |
| WO | 2020/245165 | A1 | 12/2020 | |
| WO | 2020/245223 | A1 | 12/2020 | |
| WO | 2021/041753 | A1 | 3/2021 | |
| WO | 2021/080900 | A1 | 4/2021 | |
| WO | 2021/091836 | A1 | 5/2021 | |
| WO | 2021/142188 | A | 7/2021 | |
| WO | 2021/158218 | A1 | 8/2021 | |
| WO | 2021/178304 | A1 | 10/2021 | |
| WO | 2021/243361 | A1 | 12/2021 | |
| WO | 2021/243362 | A1 | 12/2021 | |

* cited by examiner

CUTTING ELEMENTS, EARTH-BORING TOOLS INCLUDING THE CUTTING ELEMENTS, AND METHODS OF FORMING THE EARTH-BORING TOOLS

TECHNICAL FIELD

Embodiments of the present disclosure generally relate to earth-boring operations. In particular, embodiments of the present disclosure relate to cutting elements, earth-boring tools including the cutting elements, and methods of forming the earth-boring tools.

BACKGROUND

Wellbores are formed in subterranean formations for various purposes including, for example, extraction of oil and gas from the subterranean formation and extraction of geothermal heat from the subterranean formation. Wellbores may be formed in a subterranean formation using earth-boring tools, such as an earth-boring rotary drill bit. The earth-boring rotary drill bit is rotated and advanced into the subterranean formation. As the earth-boring rotary drill bit rotates, the cutting elements, cutters, or abrasive structures thereof cut, crush, shear, and/or abrade away the formation material to form the wellbore.

The earth-boring rotary drill bit is coupled, either directly or indirectly, to an end of what is referred to in the art as a "drill string," which comprises a series of elongated tubular segments connected end-to-end that extends into the wellbore from the surface of earth above the subterranean formations being drilled. Various tools and components, including the drill bit, may be coupled together at the distal end of the drill string at the bottom of the wellbore being drilled. This assembly of tools and components is referred to in the art as a "bottom-hole assembly" (BHA).

The earth-boring rotary drill bit may be rotated within the wellbore by rotating the drill string from the surface of the formation, or the drill bit may be rotated by coupling the drill bit to a downhole motor, which is coupled to the drill string and disposed proximate the bottom of the wellbore. The downhole motor may include, for example, a hydraulic Moineau-type motor having a shaft, to which the earth-boring rotary drill bit is mounted, that may be caused to rotate by pumping fluid (e.g., drilling mud or fluid) from the surface of the formation down through the center of the drill string, through the hydraulic motor, out from nozzles in the drill bit, and back up to the surface of the formation through the annular space between the outer surface of the drill string and the exposed surface of the formation within the wellbore. The downhole motor may be operated with or without drill string rotation.

Different types of earth-boring rotary drill bits are known in the art, including fixed-cutter bits, rolling-cutter bits, and hybrid bits (which may include, for example, both fixed cutters and rolling cutters). Fixed-cutter bits, as opposed to roller cone bits, have no moving parts and are designed to be rotated about the longitudinal axis of the drill string. Most fixed-cutter bits employ Polycrystalline Diamond Compact (PDC) cutting elements. The cutting edge of a PDC cutting element drills rock formations by shearing, like the cutting action of a lathe, as opposed to roller cone bits that drill by indenting and crushing the rock. The cutting action of the cutting edge influences the amount of energy needed to drill a rock formation.

A PDC cutting element generally includes a relatively thin layer (from about 1 millimeter (mm) to about 5 mm) of polycrystalline diamond, sometimes referred to as a "cutting table" or "diamond table," bonded to a cutting element substrate at an interface. The polycrystalline diamond material is often referred to as the "diamond table." A PDC cutting element generally exhibits a cylindrical shape with a diameter from about 8 mm up to about 24 mm. However, PDC cutting elements may be available in other forms such as oval or triangle-shapes and may be larger or smaller than the sizes stated above.

A PDC cutting element may be fabricated separately from the bit body and secured within cutting element pockets formed in the outer surface of a blade of the bit body. A bonding material such as an adhesive or, more typically, a braze alloy may be used to secure the PDC cutting element within the pocket. The diamond table of a PDC cutting element is conventionally formed by sintering and bonding together relatively small diamond particles under conditions of high temperature and high pressure (HTHP) in the presence of a catalyst (such as, for example, cobalt, iron, nickel, or alloys and mixtures thereof). The substrate is typically made of a metal carbide including a catalyst material and positioned adjacent to the diamond particles during formation of the diamond table, which substrate may provide the catalyst to form the diamond table of polycrystalline diamond material on, and bonded to, the cutting element substrate.

BRIEF SUMMARY

Embodiments described herein include cutting elements, earth-boring tools including the cutting elements, and methods of forming the earth-boring tools. For example, in accordance with some embodiments described herein, a cutting element includes a substrate and a cutting table secured to the substrate at an interface. The cutting table includes a superabrasive material. The cutting table also includes a first surface, a cutting surface, a first transition surface, and a second transition surface. The first surface includes an outer boundary. The cutting surface at least substantially surrounds the outer boundary of the first surface. The cutting surface is angled relative to a longitudinal centerline of the cutting table. The first transition surface is between the cutting surface and an outer lateral edge of the cutting table. The first transition surface is oriented at a first angle relative to the longitudinal centerline of the cutting table. The second transition surface is between the cutting surface and the outer lateral edge of the cutting table. The second transition surface is oriented at a second, different angle relative to the longitudinal centerline of the cutting table.

In additional embodiments, an earth-boring tool includes a bit body, a blade, and a cutting element secured to the blade. The blade extends radially outward from and in a direction parallel to a central longitudinal axis of the bit body. The blade includes a rotationally leading portion. The cutting element is secured to the blade proximate the rotationally leading portion of the blade. The cutting element includes a substrate and a cutting table secured to the substrate at an interface. The cutting table includes a superabrasive material. The cutting table also includes a first surface, a cutting surface, a first transition surface, and a second transition surface. The first surface includes an outer boundary. The cutting surface at least substantially surrounds the outer boundary of the first surface. The cutting surface is oriented at a first angle relative to a longitudinal centerline of the cutting table. The first transition surface is between the cutting surface and an outer lateral edge of the cutting table. The first transition surface is oriented at a second angle relative to the longitudinal centerline of the cutting table. The second transition surface is between the cutting surface and the outer lateral edge of the cutting table. The second transition surface is oriented at a third angle relative to the longitudinal centerline of the cutting table, the third angle is different than the second angle.

In yet additional embodiments, a method of forming an earth-boring tool includes securing a cutting element within a pocket of an earth-boring tool. The cutting element comprises a cutting table. The cutting table comprises a first surface, a cutting surface, and alternating sections of a first transition surface and a second transition surface. The cutting surface surrounds the first surface and is angled relative to a central longitudinal axis of the cutting table. Each of the first transition surface and the second transition surface are also angled differently relative to the central longitudinal axis of the cutting table.

DETAILED DESCRIPTION

Figure 1:
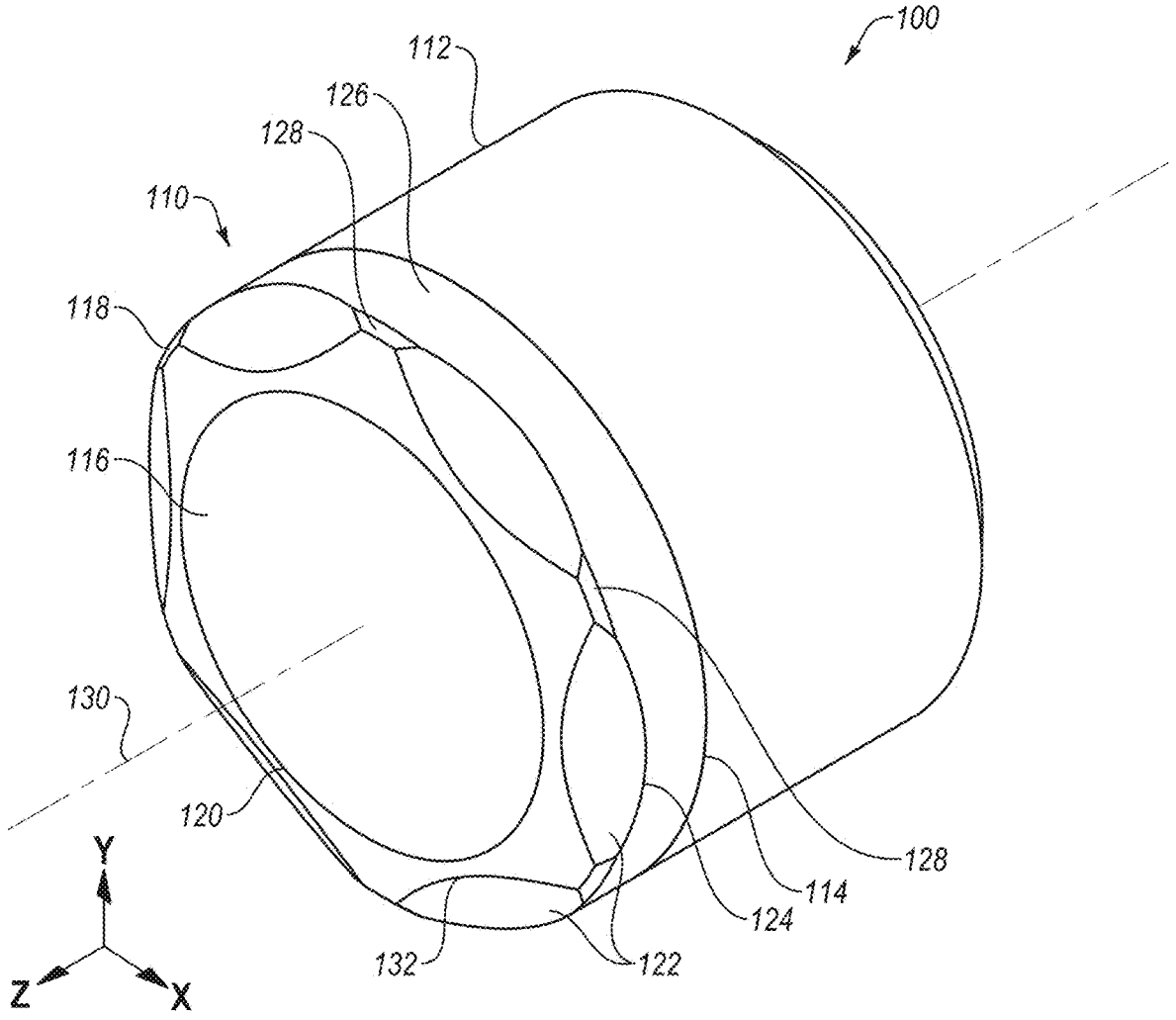
FIGS. 1-3 are a perspective view (FIG. 1), a side view (FIG. 2), and a top view (FIG. 3) of a cutting element, in accordance with embodiments of this disclosure.

Cutting elements for use in earth-boring tools are described, as are earth-boring tools including the cutting elements, and methods of forming and using the cutting elements and the earth-boring tools. In some embodiments, a cutting element includes a supporting substrate, and a cutting table attached to the supporting substrate at an interface. The cutting table may exhibit a complex geometry cutting table, such as a multi-point cutting table with arcuate face edges. The cutting element may be secured within a pocket in a structure (e.g., blade) of an earth-boring tool. Cutting elements with a multi-point cutting table and earth-boring tools including cutting elements with multi-point cutting table may provide enhanced drilling efficiency and durability compared to configurations of conventional cutting elements and conventional earth-boring tools. In addition, cutting elements with multi-point cutting tables may be designed in a way that facilitates forming such cutting elements relative to conventional cutting elements with complex geometry.

The following description provides specific details, such as specific shapes, specific sizes, specific material compositions, and specific processing conditions, in order to provide a thorough description of embodiments of the present disclosure. However, a person of ordinary skill in the art will understand that the embodiments of the disclosure may be practiced without necessarily employing these specific details. Embodiments of the disclosure may be practiced in conjunction with conventional fabrication techniques employed in the industry. In addition, the description provided below does not form a complete process flow for manufacturing a cutting element or an earth-boring tool. Only those process acts and structures necessary to understand the embodiments of the disclosure are described in detail below. Additional acts to form a complete cutting element or a complete earth-boring tool from the structures described herein may be performed by conventional fabrication processes.

Drawings presented herein are for illustrative purposes only, and are not meant to be actual views of any particular material, component, structure, device, or system. Variations from the shapes depicted in the drawings as a result, for example, of manufacturing techniques and/or tolerances, are to be expected. Thus, embodiments described herein are not to be construed as being limited to the particular shapes or regions as illustrated, but include deviations in shapes that result, for example, from manufacturing. For example, a region illustrated or described as box-shaped may have rough and/or nonlinear features, and a region illustrated or described as round may include some rough and/or linear features. Moreover, sharp angles that are illustrated may be rounded, and vice versa. Thus, the regions illustrated in the figures are schematic in nature, and their shapes are not intended to illustrate the precise shape of a region and do not limit the scope of the present claims. The drawings are not necessarily to scale. Additionally, elements common between figures may retain the same numerical designation.

The use of the term "for example," means that the related description is explanatory, and though the scope of the disclosure is intended to encompass the examples and legal equivalents, the use of such terms is not intended to limit the scope of an embodiment or this disclosure to the specified components, acts, features, functions, or the like.

As used herein, the terms "comprising," "including," and grammatical equivalents thereof are inclusive or open-ended terms that do not exclude additional, unrecited elements or method steps, but also include the more restrictive terms "consisting of" and "consisting essentially of" and grammatical equivalents thereof.

As used herein, the term "may" with respect to a material, structure, feature, or method act indicates that such is contemplated for use in implementation of an embodiment of the disclosure and such term is used in preference to the more restrictive term "is" so as to avoid any implication that other, compatible materials, structures, features, and methods usable in combination therewith should or must be excluded.

As used herein, the singular forms "a," "an," and "the" are intended to include the plural forms as well, unless the context clearly indicates otherwise.

As used herein, the term "and/or" includes any and all combinations of one or more of the associated listed items.

As used herein, the term "configured" refers to a size, shape, material composition, orientation, and arrangement of one or more of at least one structure and at least one apparatus facilitating operation of one or more of the structure and the apparatus in a predetermined way.

As used herein, the term "substantially" in reference to a given parameter, property, or condition means and includes to a degree that one of ordinary skill in the art would understand that the given parameter, property, or condition is met with a degree of variance, such as within acceptable tolerances. By way of example, depending on the particular parameter, property, or condition that is substantially met, the parameter, property, or condition may be at least 90.0 percent met, at least 95.0 percent met, at least 99.0 percent met, at least 99.9 percent met, or even 100.0 percent met.

As used herein, the term "about," when used in reference to a numerical value for a particular parameter, is inclusive of the numerical value and a degree of variance from the numerical value that one of ordinary skill in the art would understand is within acceptable tolerances for the particular parameter. For example, "about," in reference to a numerical value, may include additional numerical values within a range of from 90.0 percent to 110.0 percent of the numerical value, such as within a range of from 95.0 percent to 105.0 percent of the numerical value, within a range of from 97.5 percent to 102.5 percent of the numerical value, within a range of from 99.0 percent to 101.0 percent of the numerical value, within a range of from 99.5 percent to 100.5 percent of the numerical value, or within a range of from 99.9 percent to 100.1 percent of the numerical value.

As used herein, the term "earth-boring tool" means and includes any type of bit or tool used for drilling during the formation or enlargement of a wellbore in a subterranean formation. For example, earth-boring tools include fixed-cutter bits, roller cone bits, percussion bits, core bits, eccentric bits, bicenter bits, reamers, mills, drag bits, hybrid bits (e.g., bits including rolling components in combination with fixed cutting elements), and other drilling bits and tools known in the art.

As used herein, the term "superabrasive material" means and includes any material having a Knoop hardness value of about 3,000 Kgf/mm2 (29,418 MPa) or more. Superabrasive materials include, for example, diamond and cubic boron nitride. Superabrasive materials may also be referred to as "superhard" materials.

As used herein, the term "polycrystalline material" means and includes any structure comprising a plurality of grains (i.e., crystals) of material that are bonded directly together by inter-granular bonds. The crystal structures of the individual grains of the material may be randomly oriented in space within the polycrystalline material.

As used herein, the terms "inter-granular bond" and "interbonded" mean and include any direct atomic bond (e.g., covalent, metallic, etc.) between atoms in adjacent grains of superabrasive material.

Figure 2:
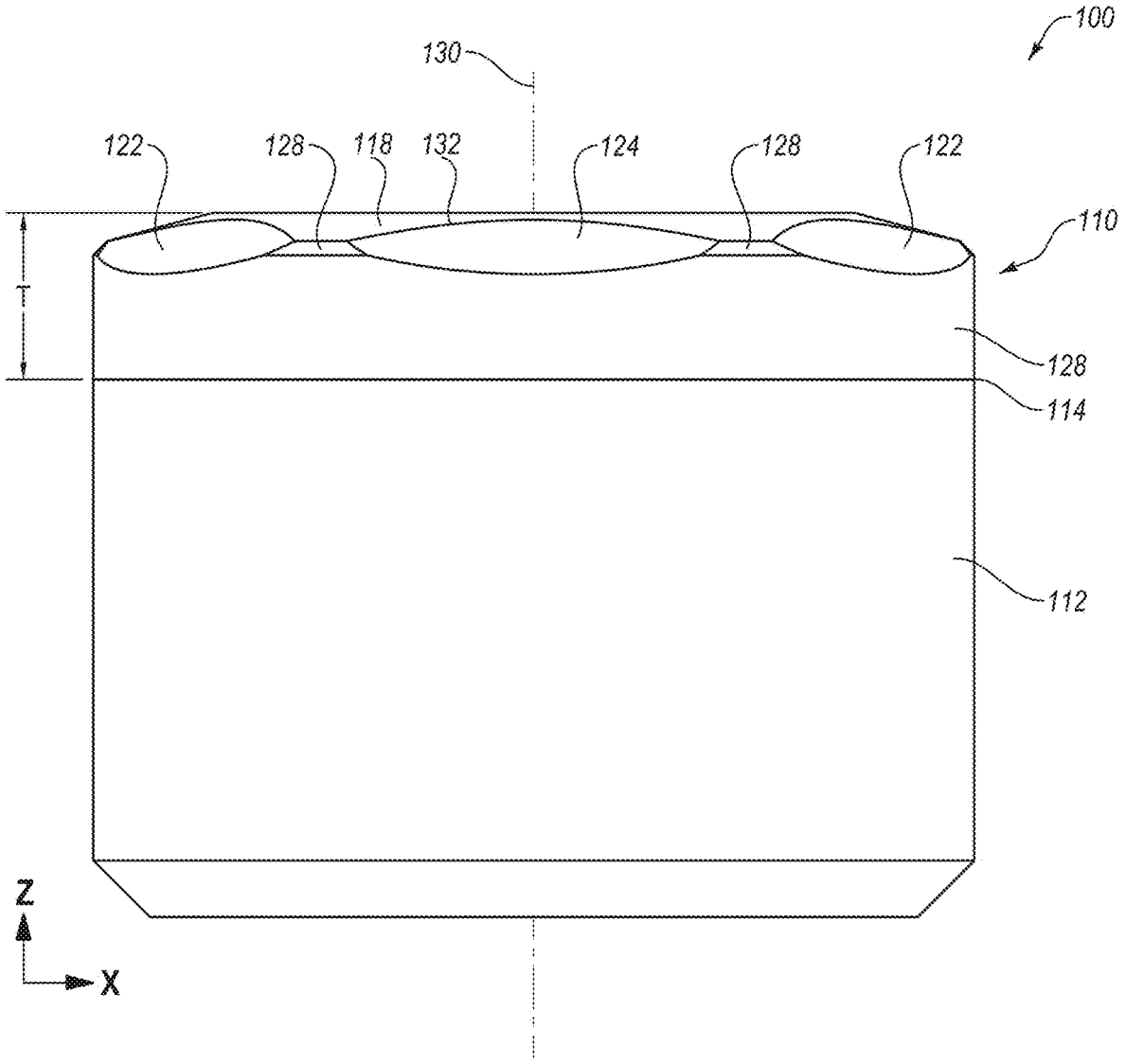
Figure 3:
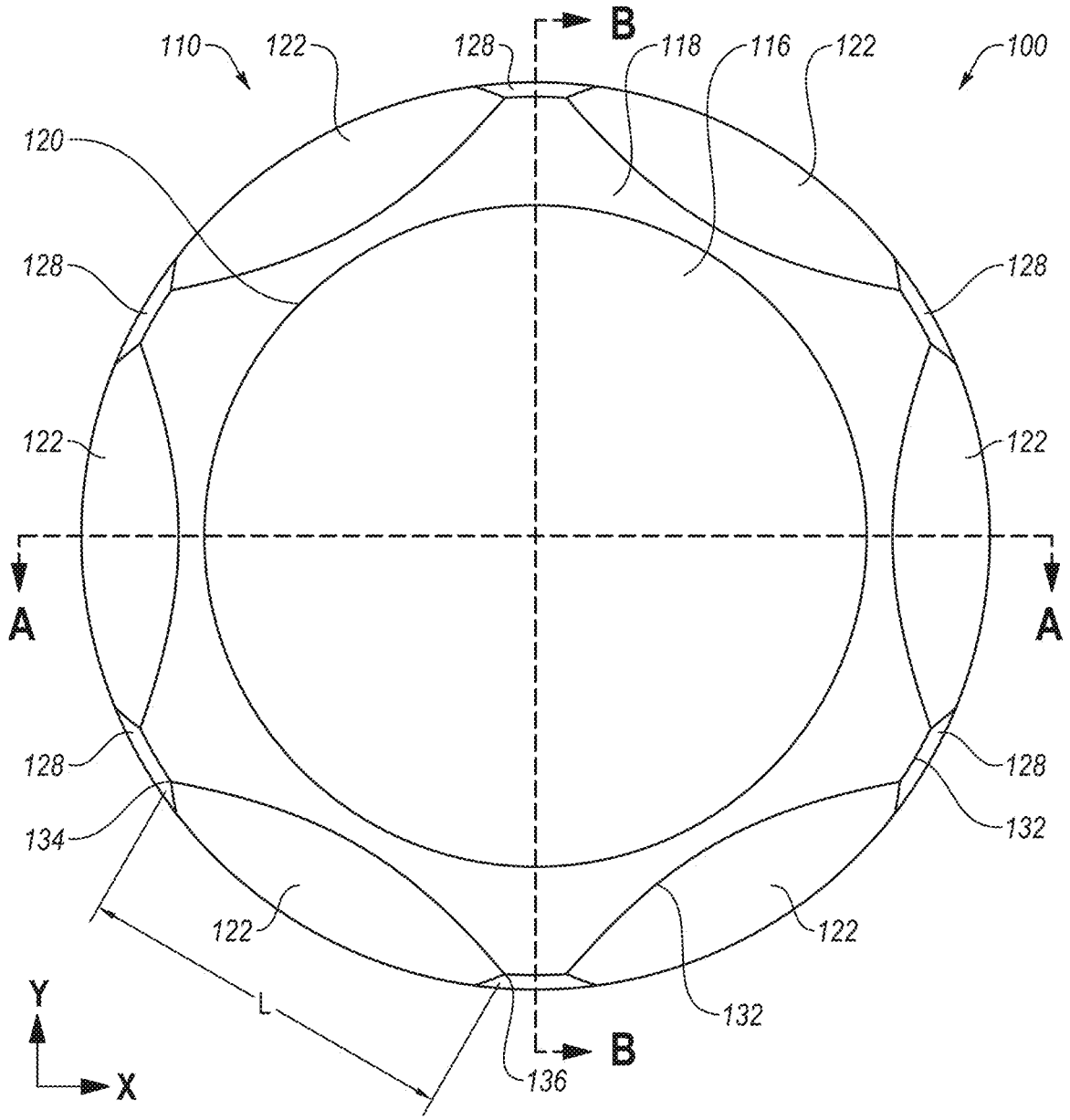

FIGS. 1-3 are a perspective view (FIG. 1), a side view (FIG. 2), and a top view (FIG. 3) of a cutting element 100, in accordance with embodiments of this disclosure. The cutting element 100 may be utilized in an earth-boring tool for drilling operations, as shown and described below with reference to FIGS. 11 and 12.

The cutting element 100 includes a cutting table 110 positioned and configured to engage with, and remove, an earth formation as the cutting element 100 is advanced toward the earth formation. The cutting table 110 may include a polycrystalline superabrasive material, such as, for example, polycrystalline diamond or cubic boron nitride. The cutting table 110 may be secured to an end of a substrate 112, forming an interface 114 between the cutting table 110 and the substrate 112. The substrate 112 may include a hard, wear-resistant material suitable for use in the downhole environment. For example, the substrate 112 may include a ceramic-metallic composite material (i.e., a cermet), including particles of a carbide or nitride material (e.g., tungsten carbide) in a matrix of a metal material (e.g., a solvent metal catalyst material configured to catalyze the formation of intergranular bonds among grains of the superabrasive material of the cutting table 110).

The substrate 112 of the cutting element 100 may exhibit a size and/or shape complementary to the size and/or shape of the cutting table 110. For example, the substrate 112 may exhibit lateral dimensions (e.g., in the X-direction and/or the Y-direction) within a range of from about 8 mm up to about 24 mm. The substrate 112 may exhibit longitudinal dimensions (e.g., in the Z-direction), also referred to as a thickness, within a range of from about 5 mm up to about 100 mm. In addition, the substrate 112 may exhibit any desired shape. For example, the substrate 112 may exhibit a cylindrical shape, a conical shape, a frustoconical shape, a triangular prism shape, a rectangular prism shape, a combination of two or more of the foregoing shapes, etc.

The cutting table 110 of the cutting element 100 may include a first surface 116 at a first end of the cutting table 110 opposite a second end of the cutting table 110 that may be connected to the substrate 112. The first surface 116 may be substantially planar or curved (e.g., concave, convex, etc.).

A thickness T of the cutting table 110 may be defined by a maximum longitudinal distance (e.g., in the Z-direction) from the first end (e.g., the first surface 116) of the cutting table 110 to the second end of the cutting table 110. The thickness T of the cutting table 110 may be within a range of from about 1 mm to about 5 mm, such as from about 2 mm to about 5 mm, from about 2 mm to about 4 mm (e.g., about 3 mm).

The cutting table 110 may additionally include a cutting surface 118 at least partially (e.g., partially, substantially, entirely) surrounding an outer boundary 120 of the first surface 116. In some embodiments, such as that shown in FIGS. 1-3, the cutting table 110 may additionally include a first transition surface 122 between the cutting surface 118 and an outer lateral edge 124 at a periphery of the cutting table 110. The cutting table 110 may further include a second transition surface 128 between the cutting surface 118 and the outer lateral edge 124 of the cutting table 110. In some embodiments, the outer lateral edge 124 is an edge of a lateral surface 126 of the cutting table 110. In additional embodiments, the first transition surface 122 may extend through the full thickness T of the cutting table 110 such that there is only an outer lateral edge 124 without a lateral surface 126. Each of the cutting surface 118, the first transition surface 122, and the second transition surface 128 may be angled relative to a longitudinal centerline 130 (e.g., central longitudinal axis) of the cutting table 110 and/or relative to one another.

In additional embodiments, the first transition surface 122 may be a continuous surface surrounding the cutting surface 118, and the second transition surface 128 may be between at least a portion of the second transition surface 128 and an outer lateral edge 124.

The first transition surface 122 may include discrete sections separated by additional discrete sections of the second transition surface 128. For example, the discrete sections of the first transition surface 122 may arranged around an outer or peripheral portion of the cutting table 110 in an alternating sequence with the additional discrete sections of the second transition surface 128. As shown in FIGS. 1-3, the first transition surface 122 may include six discrete sections that may be arranged around the outer portion of the cutting table 110 in an alternating sequence with six additional discrete sections of the second transition surface 128. The cutting table 110 and/or the cutting element 100 may include any number of sections of the first transition surface 122 and the second transition surface 128, such as a single section, two sections, three sections, four sections (such as that shown in FIGS. 9 and 10), eight sections (such as that shown in FIGS. 11 and 12), etc.

Intersections between the cutting surface 118 and the first transition surface 122 (e.g., the discrete sections of the first transition surface 122), and/or between the cutting surface 118 and the second transition surface 128 (e.g., the additional discrete sections of the second transition surface 128) may define a cutting edge 132 of the cutting table 110, which is also an outer boundary or peripheral edge of the cutting surface 118. At least a portion of the cutting edge 132 may be positioned on an earth-boring tool to first engage the earth formation during drilling operations to form the wellbore. The angles of the cutting surface 118 and the transition surfaces 122, 128 relative to the longitudinal centerline 130, and the sizes of the transition surfaces 122, 128 may be customized as desired to achieve a cutting edge 132 exhibiting a desired shape and/or size. In the embodiment shown in FIG. 3, the cutting edge 132 follows an outer boundary of a star shape with substantially flat point edges, and arcuate side edges between the flat point edges.

The shapes, angles, and relative dimensions of the cutting surface 118, the first transition surface 122, and/or the second transition surface 128 contemplated in this disclosure may be designed to achieve a desired aggressiveness of the cutting edge 132 of the cutting element 100, while also minimizing maximum (peak) stresses on the cutting table 110 by reducing point loading on the cutting table 110. In addition, the shapes, angles, and relative dimensions of the surfaces 118, 122, 128 may reduce the risk of torsional overloading in drilling applications. Minimizing the peak tensile stresses and/or the risk of torsional overloading on the cutting table 110 may improve wear resistance and longevity of the cutting element 100, and may also enhance drilling efficiency in certain earth formations.

The sizes of the first surface 116, the cutting surface 118, the first transition surface 122, and the second transition surface 128 may be selected such that each surface 116, 118, 122, and 128 occupies a certain percentage of an end surface area of the cutting table 110. The end surface area of the cutting table 110 may be the sum of the surface areas of the first surface 116, the cutting surface 118, the first transition surface 122, and the second transition surface 128. For example, the actual surface area of angled and/or arcuate surfaces may be included for the end surface area, rather than a projected surface area (e.g., in the X-Y plane).

The surface area of the first surface 116 may be larger, smaller, or substantially the same size as the surface areas of each of the cutting surface 118, the first transition surface 122, and the second transition surface 128. The first surface 116 may occupy a surface area within a range of from about 10% to about 95%, such as from about 20% to about 90%, from about 30% to about 80%, or from about 40% to about 70% (e.g., about 40%, about 50%, about 60%, or about 70%) of the end surface area of the cutting table 110. For example, the first surface 116 may occupy about 10%, about 20%, about 30% about 30%, about 40%, about 50%, or about 60% of the end surface area of the cutting table 110. In addition, the first surface 116 may be planar or curved (e.g., concave, convex, etc.).

The surface area of the cutting surface 118 may be larger, smaller, or substantially the same size as the surface areas of each of the first transition surface 122 and the second transition surface 128. The cutting surface 118 may occupy a surface area within a range of from about 10% to about 90%, such as from about 15% to about 80%, from about 20% to about 70%, or from about 25% to about 60% of the end surface area of the cutting table 110. For example, the first surface 116 may occupy about 10%, about 20%, about 30% about 30%, about 40%, about 50%, or about 60% of the end surface area of the cutting table 110. In addition, the cutting surface 118 may be substantially planar (chamfered) or curved (e.g., concave, convex, etc.) relative to the longitudinal centerline 130.

The first transition surface 122 (e.g., the collective surface area of the discrete sections of the first transition surface 122) may occupy a surface area within a range of from about 5% to about 30%, such as from about 10% to about 25%, or from about 15% to about 20% of the end surface area of the cutting table 110. For example, the first surface 116 may occupy about 5%, about 10% about 15%, about 20%, about 25%, or about 30% of the end surface area of the cutting table 110. The surface area of the first transition surface 122 may be larger, smaller, or substantially the same size as the surface area of the second transition surface 128. In addition, the first transition surface 122 (e.g., sections of the first transition surface 122) may be substantially planar (e.g., chamfered) or curved (e.g., concave, convex, etc.) relative to the longitudinal centerline 130. In addition, the first transition surface 122 (e.g., sections of the first transition surface 122) may be substantially planar or curved (e.g., concave, convex, etc.) along a length L of the first transition surface 122, where the length L is defined as a distance from a maximum distance from a first edge 134 at one end of the first transition surface 122 to a second edge 136 at another, opposite end of the first transition surface 122. In embodiments in which the first transition surface 122 includes multiple discrete sections (shown in FIGS. 1-3), the length L of each section of the first transition surface 122 is defined as a maximum distance from a first edge 134 at an end of a section of the first transition surface 122 to a second edge 136 at an opposite end of the section of the first transition surface 122.

The second transition surface 128 (e.g., the collective surface area of the discrete sections of the first transition surface 122) may occupy a surface area within a range of from about 1% to about 25%, such as from about 3% to about 20%, or from about 5% to about 15% of the end surface area of the cutting table 110. For example, the first surface 116 may occupy about 1%, about 5%, about 8%, about 10%, about 12%, about 14%, about 16%, about 18%, about 20%, or about 25% of the end surface area of the cutting table 110.

As shown in the embodiment illustrated in FIGS. 1-3, the first surface 116 occupies about 60% of the end surface area of the cutting table 110, the cutting surface 118 occupies about 15% of the end surface area of the cutting table 110, the first transition surface 122 (e.g., the collective surface area of the discrete sections of the first transition surface 122) occupies about 20% of the end surface area of the cutting table 110, and the second transition surface 128 (e.g., the collective surface area of the discrete sections of the first transition surface 122) occupies about 5% of the end surface area of the cutting table 110.

Figure 4:
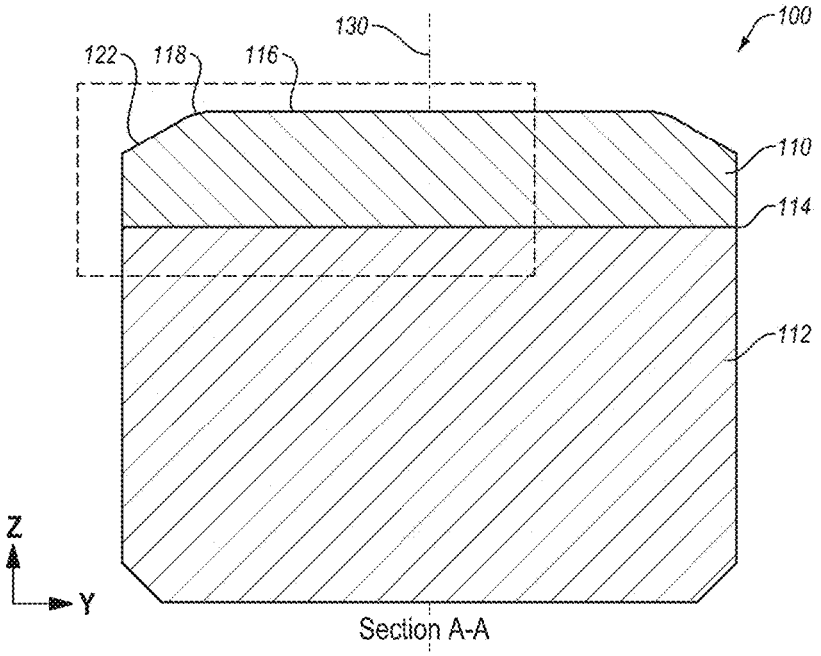
FIGS. 4 and 5 are cross-sectional views of the cutting element of FIG. 1, taken along the section A-A plane of FIG. 3, in accordance with embodiments of this disclosure.
Figure 5:
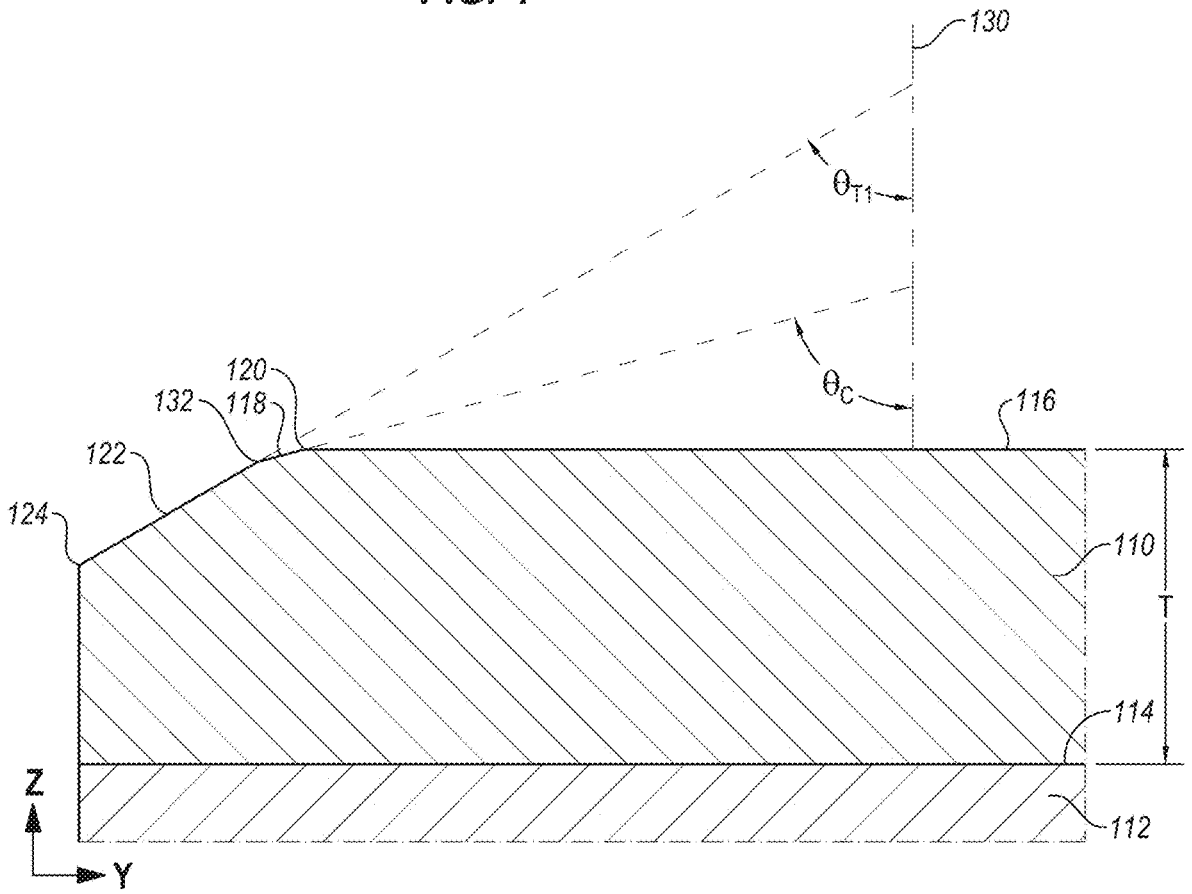
Figure 6:
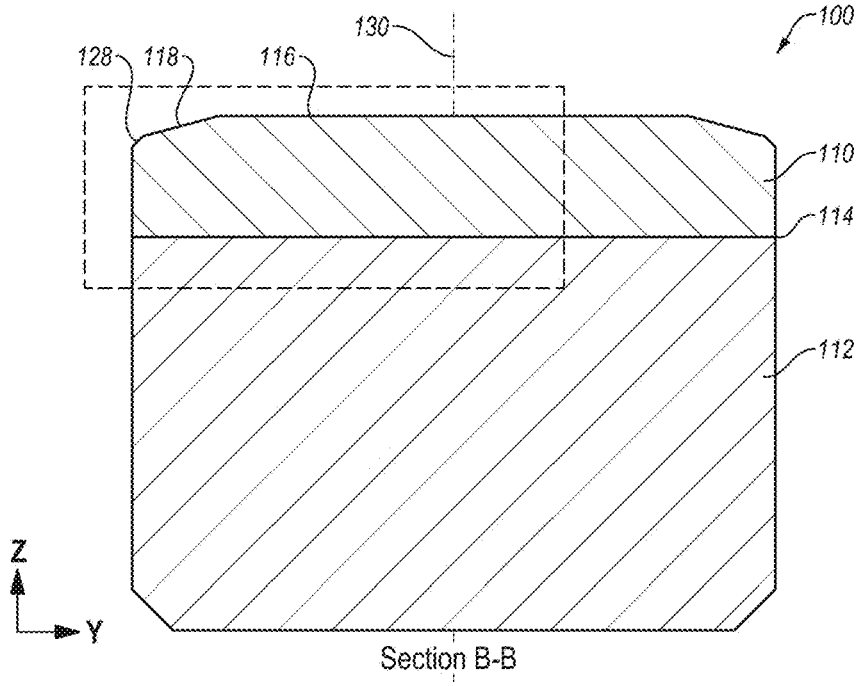
FIGS. 6 and 7 are cross-sectional views of the cutting element of FIG. 1, taken along the section B-B plane of FIG. 3, in accordance with embodiments of this disclosure.
Figure 7:
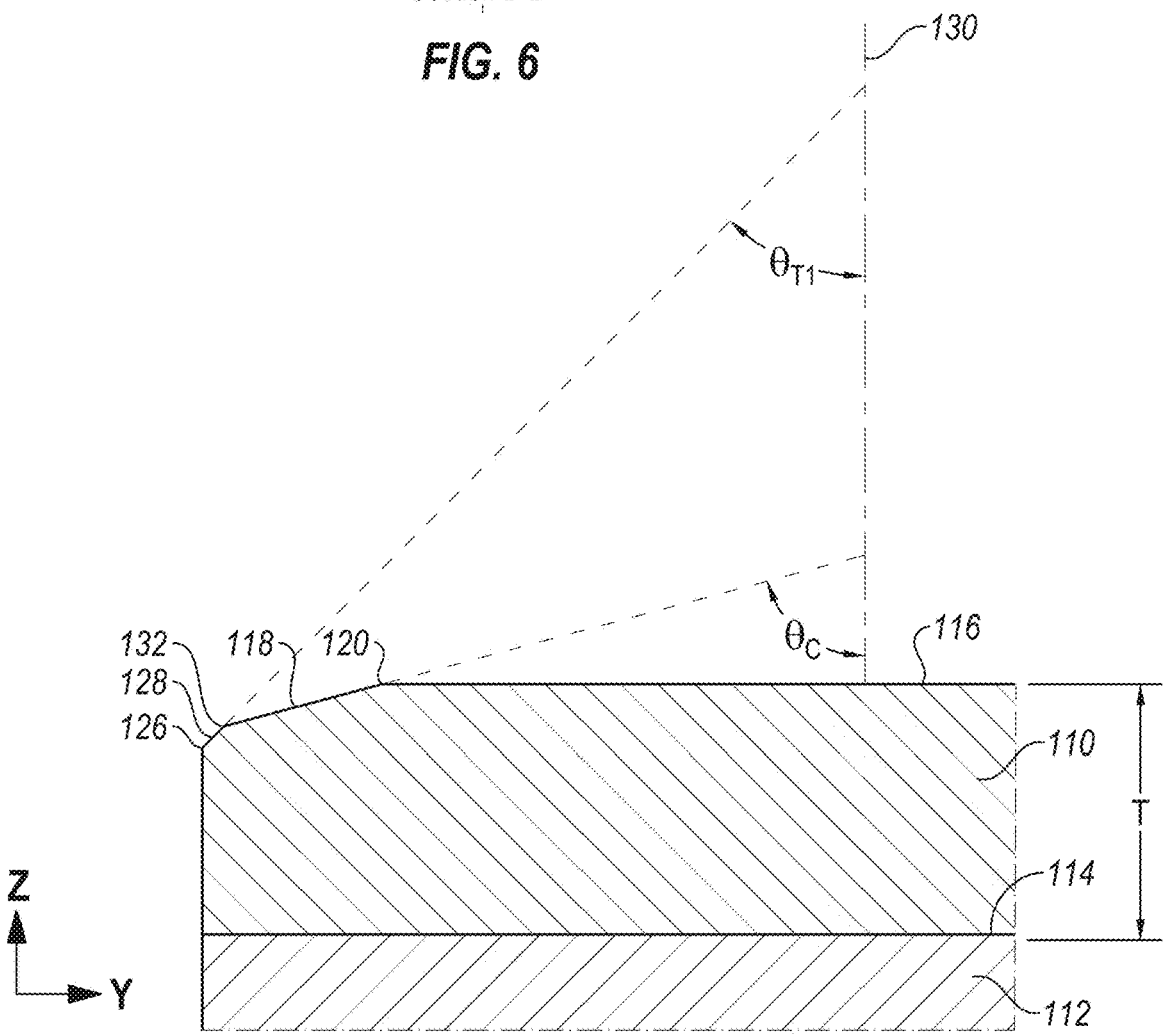

FIG. 3 includes section planes A-A and B-B through the X-Y plane of the cutting element 100. For example, the section A-A plane extends through the first surface 116, the cutting surface 118, and a central portion of sections of the first transition surface 122. The section B-B plane extends through the first surface 116, the cutting surface 118, and a central portion of sections of the second transition surface 128. FIGS. 4 and 5 show the section A-A plane, and FIGS. 6 and 7 show the section B-B plane.

Referring now to FIGS. 4 and 5, section A-A is a view of the cross-section through the center the cutting element 100 in the Y-Z plane. FIG. 5 is an enlarged region of the section A-A plane of FIG. 4. The cutting surface 118 extends from the outer boundary 120 of the first surface to the cutting edge 132, and the first transition surface 122 extends from the cutting edge 132 to the outer lateral edge 124 of the cutting table 110.

As shown in FIG. 5, the cutting surface 118 and the first transition surface 122 are angled relative to the longitudinal centerline 130 of the cutting table 110. The cutting surface 118 may be oriented at an angle ($\theta_C$) relative to the longitudinal centerline 130 of the cutting table 110. While shown as planar in the embodiment of FIGS. 4 and 5, in some embodiments, the cutting surface 118 may be curved (e.g., concave, convex, etc.). In such embodiments, the angle ($\theta_C$) may be an average of the sum of the angles of the cutting surface 118 relative to the longitudinal centerline 130. For example, the angle ($\theta_C$) may be within a range of from about 60 degrees)(° to about 90 degrees, such as from about 60 degrees to about 80 degrees, or from about 65 degrees to about 75 degrees. As specific non-limiting examples, the angle ($\theta_C$) may be about 60 degrees, about 65 degrees, about 70 degrees, about 75 degrees, about 80 degrees, about 85 degrees, or about 90 degrees.

The maximum depth of the cutting surface 118, or position of the cutting edge 132 relative to the longitudinally outermost portion at the first end of the cutting table 110 (shown as the first surface 116) may be from about 0 mm to about 1 mm, such as from about 0.25 mm to about 0.75 mm (e.g., about 0.5 mm). Accordingly, a thickness of the diamond table along the cutting surface 118 and at the cutting edge 132 may be less than the thickness T of the cutting table 110 by the depth relative to the longitudinally outermost portion at the first end of the cutting table 110.

The first transition surface 122 may be oriented at a first transition angle ($\theta_{T1}$) relative to the longitudinal centerline 130 of the cutting table 110. Although shown as planar in the embodiment of FIGS. 4 and 5, in some embodiments, the first transition surface 122 may be curved (e.g., concave, convex, etc.). In such embodiments, the first transition angle ($\theta_{T1}$) may be an average of the sum of the angles of the first transition surface 122 relative to the longitudinal centerline 130. For example, the first transition angle ($\theta_{T1}$) may be within a range of from about 40 degrees)(° to about 90 degrees, such as from about 45 degrees to about 80 degrees, from about 50 degrees to about 75 degrees, or from about 50 degrees to about 65 degrees. As specific non-limiting examples, the first transition angle ($\theta_{T1}$) may be about 40 degrees, about 45 degrees, about 50 degrees, about 55 degrees, about 60 degrees, about 65 degrees, about 70 degrees, or about 75 degrees.

The maximum depth of the first transition surface 122, or position of the outer lateral edge 124 relative to the longitudinally outermost portion at the first end of the cutting table 110 (shown as the first surface 116) may be from about 0.25 mm to about 2 mm, such as from about 0.5 mm to about 1.5 mm (e.g., about 0.9 mm, about 1 mm, or about 1.1 mm). Accordingly, a thickness of the diamond table along the first transition surface 122 and at the outer lateral edge 124 may be less than the thickness T of the cutting table 110 by the depth relative to the longitudinally outermost portion at the first end of the cutting table 110.

Referring now to FIGS. 6 and 7, section B-B is a view of the cross-section through the center the cutting element 100 in the X-Z plane. FIG. 7 is an enlarged region of the section B-B plane of FIG. 6. The cutting surface 118 extends from the outer boundary 120 of the first surface to the cutting edge 132, and the second transition surface 128 extends from the cutting edge 132 to the outer lateral edge 124 of the cutting table 110.

As shown in FIG. 7, the cutting surface 118 and the second transition surface 128 are angled relative to the longitudinal centerline 130 of the cutting table 110. The cutting surface 118 may be oriented at the angle ($\theta_C$) relative to the longitudinal centerline 130 of the cutting table 110, which was shown and described above with reference to FIGS. 4 and 5.

The maximum depth of the cutting surface 118, or position of the cutting edge 132 relative to the longitudinally outermost portion at the first end of the cutting table 110 (shown as the first surface 116) may be from about 0 mm to about 1.5 mm, such as from about 0.25 mm to about 1.25 mm (e.g., about 0.75 mm). Accordingly, a thickness of the diamond table along the cutting surface 118 and at the cutting edge 132 may be less than the thickness T of the cutting table 110 by the depth relative to the longitudinally outermost portion at the first end of the cutting table 110. In addition, the part of the cutting edge 132 shown in FIG. 7 may be at a greater depth than the part of the cutting edge 132 shown in FIG. 5.

The second transition surface 128 may be oriented at a first angle ($\theta_{T2}$) relative to the longitudinal centerline 130 of the cutting table 110. Although shown as planar in the embodiment of FIGS. 6 and 7, in some embodiments, the second transition surface 128 may be curved (e.g., concave, convex, etc.). In such embodiments, the angle ($\theta_{T2}$) may be an average of the sum of the angles of the second transition surface 128 relative to the longitudinal centerline 130. For example, the first angle ($\theta_{T2}$) may be within a range of from about 20 degrees)(°) to about 70 degrees, such as from about 35 degrees to about 55 degrees, or from about 40 degrees to about 50 degrees. As specific non-limiting examples, the first angle ($\theta_{T1}$) may be about 20 degrees, about 30 degrees, about 35 degrees, about 40 degrees, about 45 degrees, about 50 degrees, about 55 degrees, about 60 degrees, or about 70 degrees.

The maximum depth of the second transition surface 128, or position of the outer lateral edge 124 relative to the longitudinally outermost portion at the first end of the cutting table 110 (shown as the first surface 116) may be from about 0.25 mm to about 2 mm, such as from about 0.5 mm to about 1.5 mm (e.g., about 0.9 mm, about 1 mm, or about 1.1 mm). Accordingly, a thickness of the diamond table along the second transition surface 128 and at the outer lateral edge 124 may be less than the thickness T of the cutting table 110 by the depth relative to the longitudinally outermost portion at the first end of the cutting table 110. In some embodiments, the longitudinal position of the outer lateral edge 124 (e.g., the depth relative to the first surface 116) may be constant around the periphery of the cutting table 110. In additional embodiments the longitudinal position of the outer lateral edge 124 may vary around the periphery of the cutting table 110. For example, the longitudinal position of the outer lateral edge 124 may vary relative to the thickness T of the cutting table 110.

Figure 8:
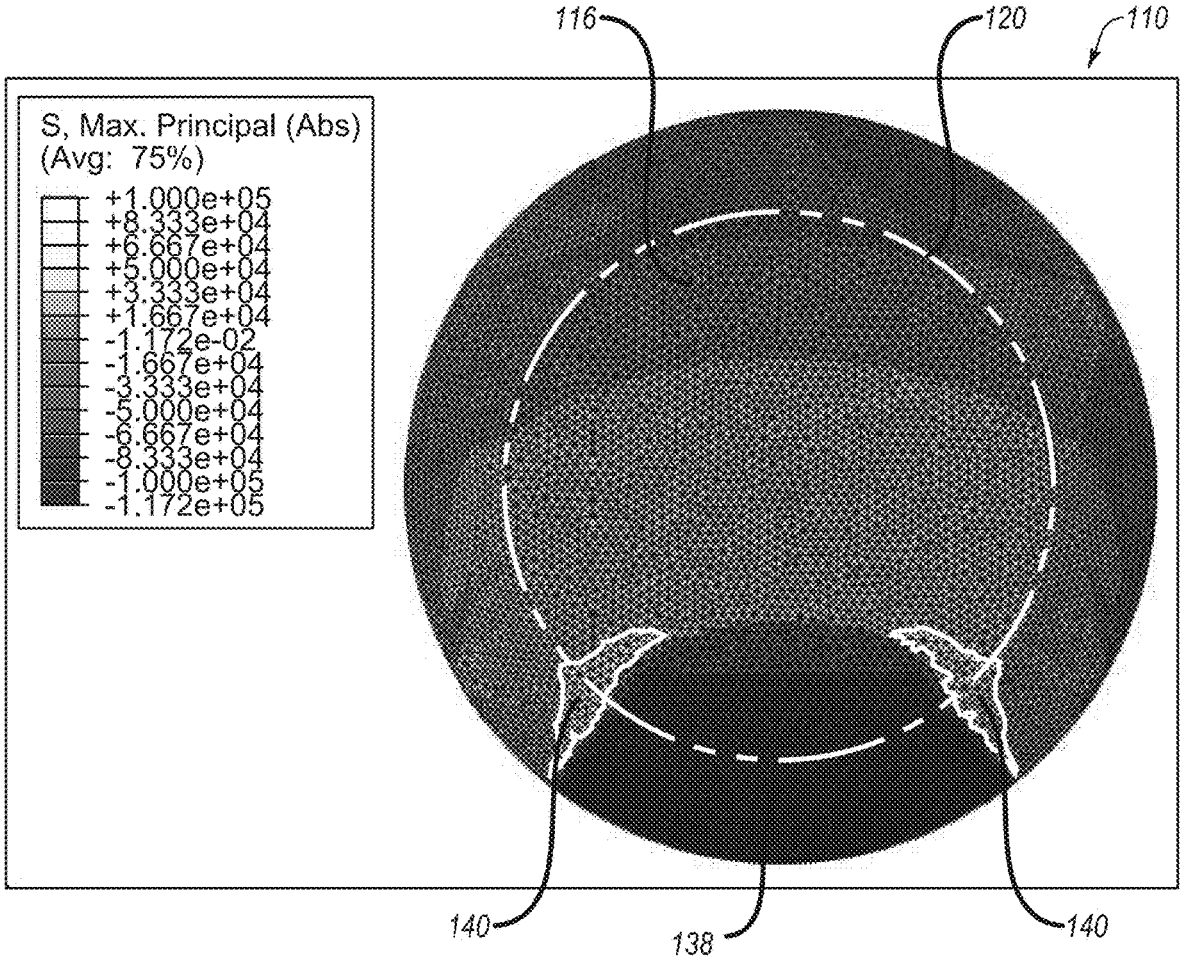
FIG. 8 is a finite element analysis (FEA) showing stresses on a cutting surface of the cutting element of FIG. 1 during drilling operations, in accordance with embodiments of this disclosure.

FIG. 8 is a chart showing a finite element analysis of stress (e.g., tensile stress) on the cutting element 100 of FIGS. 1-7 during testing to simulate stresses during drilling operations. Pressure may be applied uniformly across a cutting region 138 of the cutting table 110 to place the cutting region 138 in tension and the remaining region of the cutting table 110 in tension. In drilling operations, the pressure applied to the cutting region 138 may be non-uniform so the applied pressure applied to the cutting region 138 may be an average pressure. The peak tensile stress occurs proximate two edge regions 140 on the outer boundary 120 of the first surface 116 and proximate edges of the cutting region 138. The peak tensile stress on the cutting table 110 may be within a range of from about 45% to about 48% (e.g., about 46%, or about 47%) of the average pressure applied to the cutting region 138. Thus, the maximum tensile stress on the cutting table 110 is relative to the pressure/force applied to the cutting region 138 of the cutting table 110. In FIG. 8, a pressure of about 100,000 psi (about 689.475 Megapascals (MPa)) applied uniformly across the cutting region 138 of the cutting table 110 results in a maximum tensile stress within the edge regions 140 of the cutting table 110. The magnitude of the maximum tensile stress within the edge regions 140 is within a range of from about 46,000 pounds per square inch (psi) (324.054 Megapascals (MPa)) to about 47,000 psi (317.159 MPa), such as about 46,000 psi (about 324.054 MPa), or about 47,000 psi (317.159 MPa). The magnitude of the maximum tensile stress on the cutting table 110 may be significantly lower (from about 20% to about 80% lower) than other cutting elements with non-planar cutting tables.

Figure 9:
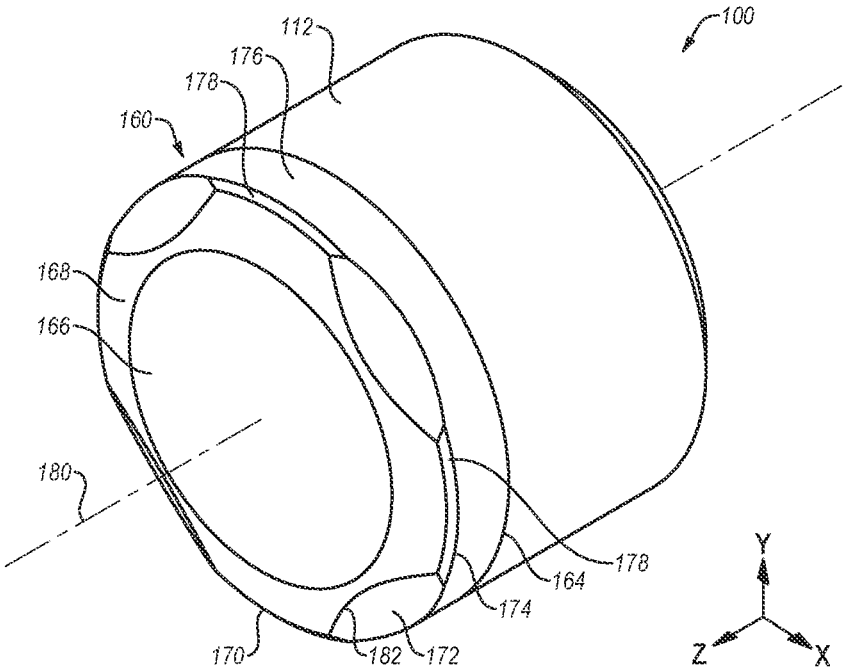
FIGS. 9 and 10 are a perspective view (FIG. 9) and a side view (FIG. 10) of another cutting element, in accordance with embodiments of this disclosure.
Figure 10:
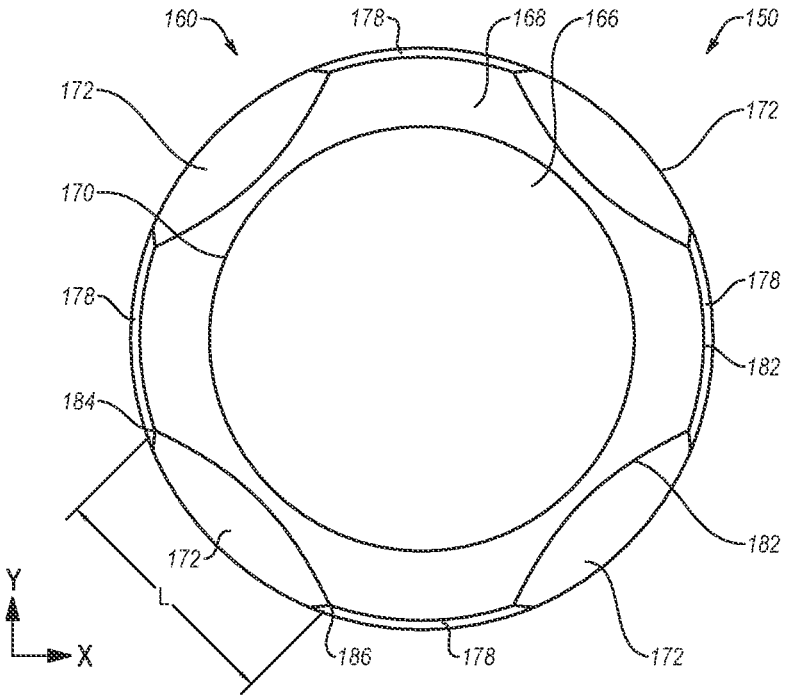

FIGS. 9 and 10 are a perspective view (FIG. 9) and a top view (FIG. 10) of another cutting element 150 in accordance with embodiments of this disclosure. The cutting element 150 may be similar to the cutting element 100 (FIG. 1). For example, the cutting element 150 includes a cutting table 160 that may be similar to the cutting table 110. The cutting table 160 may include a polycrystalline superabrasive material, such as, for example, polycrystalline diamond or cubic boron nitride. Similar to the cutting table 110, the cutting table 160 may be secured to an end of the substrate 112, forming an interface 164 between the cutting table 160 and the substrate 112.

In addition, the cutting table 160 may also include a first surface 166, a cutting surface 168 arranged around at least a portion of an exterior boundary 170 of the first surface 166. The cutting table 160 may further include a first transition surface 172 extending between the cutting surface 168 and an outer lateral edge 174 of a lateral surface 176 of the cutting table 160. The cutting table 160 may further include a second transition surface 178 between the cutting surface 168 and the outer lateral edge 174. The first transition surface 172 and the second transition surface 178 may each include four discrete sections in an alternating arrangement around a periphery of the cutting table 160. In addition, each of the cutting surface 168, the first transition surface 172 and the second transition surface 178 may be angled relative to a longitudinal centerline 180, similar to the cutting table 110. Similar to the cutting surface 118, the first transition surface 122, and the second transition surface 128 of the cutting table 110, the cutting surface 168 may be oriented at an angle ($\theta_C$) relative to the longitudinal centerline 180 of the cutting table 160, the first transition surface 172 may oriented at a first transition angle ($\theta_{T1}$) relative to the longitudinal centerline 180 of the cutting table 160, and the second transition surface 178 may oriented at a first angle ($\theta_{T2}$) relative to the longitudinal centerline 180 of the cutting table 160.

Intersections between the cutting surface 168 and the first transition surface 172 (e.g., the discrete sections of the first transition surface 172), and/or between the cutting surface 168 and the second transition surface 178 (e.g., the additional discrete sections of the second transition surface 178) may define a cutting edge 182 of the cutting table 160, which is also an outer boundary or peripheral edge of the cutting surface 168. At least a portion of the cutting edge 182 may be positioned to first engage the earth formation during drilling operations to form the wellbore. The angles of the cutting surface 168 and the transition surfaces 172, 178 relative to the longitudinal centerline 180, and the sizes of the transition surfaces 172, 178 may be customized as desired to achieve a cutting edge 182 exhibiting a desired shape and/or size. In the embodiment shown in FIG. 10, the cutting edge 182 follows an outer boundary of a cross shape with substantially flat point edges, and arcuate side edges between the flat point edges.

The shapes, angles, and relative dimensions of the cutting surface 168, the first transition surface 172, and/or the second transition surface 178 contemplated in this disclosure may be designed to achieve a desired aggressiveness of the cutting edge 182 of the cutting element 150, while also minimizing maximum (peak) stresses on the cutting table 160 by reducing point loading on the cutting table 160. In addition, the shapes, angles, and relative dimensions of the surfaces 168, 172, 178 may reduce the risk of torsional overloading in drilling applications. Minimizing the peak tensile stresses and/or the risk of torsional overloading on the cutting table 160 may improve wear resistance and longevity of the cutting element 150, and may also enhance drilling efficiency in certain earth formations.

The sizes of the first surface 166, the cutting surface 168, the first transition surface 172, and the second transition surface 178 may be selected such that each surface 166, 168, 172, and 178 occupies a certain percentage of an end surface area of the cutting table 160. The end surface area of the cutting table 160 may be the sum of the surface areas of the first surface 166, the cutting surface 168, the first transition surface 172, and the second transition surface 178. For example, the actual surface area of angled and/or arcuate surfaces may be included for the end surface area, rather than a projected surface area (e.g., in the X-Y plane).

Similar to the cutting table 110, the surface area occupied by any of the first surface 166, the cutting surface 168, the first transition surface 172, and the second transition surface 178 of the cutting table 160 may be larger, substantially the same size as, or smaller than any other of the first surface 166, the cutting surface 168, the first transition surface 172, and/or the second transition surface 178. For example, as shown in the embodiment illustrated in FIGS. 9 and 10, the first surface 166 occupies about 60% of the end surface area of the cutting table 160, the cutting surface 168 occupies about 20% of the end surface area of the cutting table 160, the first transition surface 172 (e.g., the collective surface area of the discrete sections of the first transition surface 172) occupies about 14% of the end surface area of the cutting table 160, and the second transition surface 178 (e.g., the collective surface area of the discrete sections of the first transition surface 172) occupies about 6% of the end surface area of the cutting table 160.

In addition, the first transition surface 172 (e.g., sections of the first transition surface 172) may be substantially planar or curved (e.g., concave, convex, etc.) along a length L of the first transition surface 172, where the length L is defined as a distance from a maximum distance from a first edge 184 at one end of the first transition surface 172 to a second edge 186 at another, opposite end of the first transition surface 172. In embodiments in which the first transition surface 172 includes multiple discrete sections (shown in FIGS. 9 and 10), the length L of each section of the first transition surface 172 is defined as a maximum distance from a first edge 184 at an end of a section of the first transition surface 172 to a second edge 186 at an opposite end of the section of the first transition surface 172.

Figure 11:
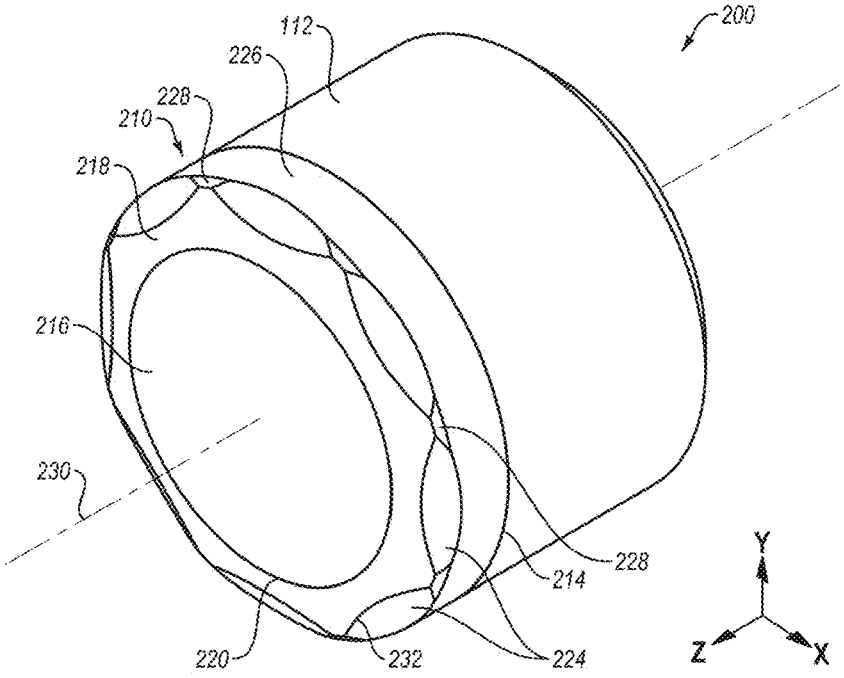
FIGS. 11 and 12 are a perspective view (FIG. 11) and a side view (FIG. 12) of an additional cutting element, in accordance with embodiments of this disclosure.
Figure 12:
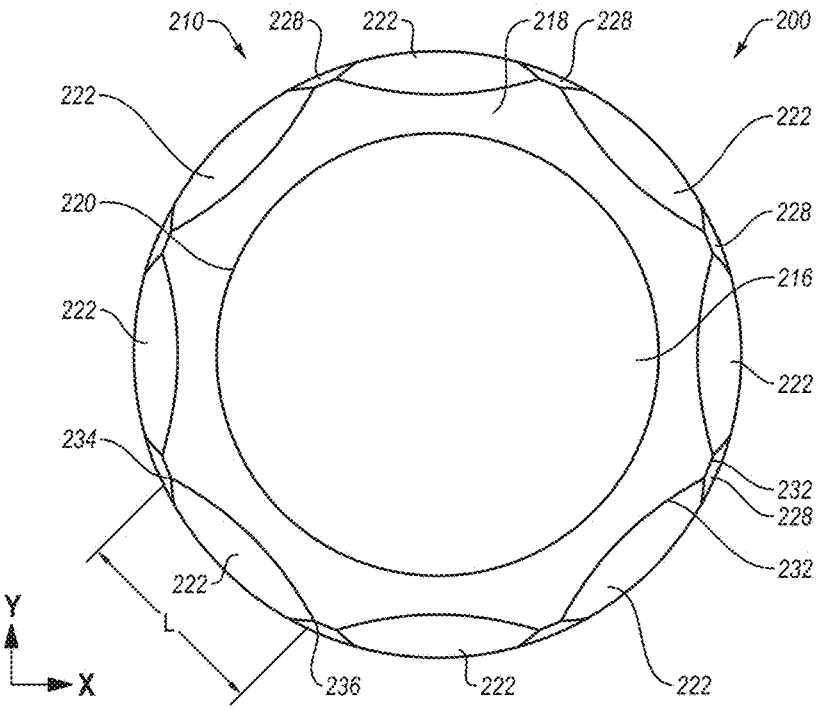

FIGS. 11 and 12 are a perspective view (FIG. 11) and a top view (FIG. 12) of another cutting element 200 in accordance with embodiments of this disclosure. The cutting element 200 may be similar to the cutting element 100 (FIG. 1). For example, the cutting element 200 includes a cutting table 210 that may be similar to the cutting table 110. The cutting table 210 may include a polycrystalline superabrasive material, such as, for example, polycrystalline diamond or cubic boron nitride. Similar to the cutting table 110, the cutting table 210 may be secured to an end of the substrate 112, forming an interface 214 between the cutting table 210 and the substrate 112.

In addition, the cutting table 210 may also include a first surface 216, a cutting surface 218 arranged around at least a portion of an exterior boundary 220 of the first surface 216. The cutting table 210 may further include a first transition surface 222 extending between the cutting surface 218 and an outer lateral edge 224 of a lateral surface 226 of the cutting table 210. The cutting table 210 may further include a second transition surface 228 between the cutting surface 218 and the outer lateral edge 224. The first transition surface 222 and the second transition surface 228 may each include four discrete sections in an alternating arrangement around a periphery of the cutting table 210. In addition, each of the cutting surface 218, the first transition surface 222 and the second transition surface 228 may be angled relative to a longitudinal centerline 230, similar to the cutting table 110. Similar to the cutting surface 118, the first transition surface 122, and the second transition surface 128 of the cutting table 110, the cutting surface 218 may be oriented at an angle ($\theta_C$) relative to the longitudinal centerline 230 of the cutting table 210, the first transition surface 222 may oriented at a first transition angle ($\theta_{T1}$) relative to the longitudinal centerline 230 of the cutting table 210, and the second transition surface 228 may oriented at a first angle ($\theta_{T2}$) relative to the longitudinal centerline 230 of the cutting table 210.

Intersections between the cutting surface 218 and the first transition surface 222 (e.g., the discrete sections of the first transition surface 222), and/or between the cutting surface 218 and the second transition surface 228 (e.g., the additional discrete sections of the second transition surface 228) may define a cutting edge 232 of the cutting table 210, which is also an outer boundary or peripheral edge of the cutting surface 218. At least a portion of the cutting edge 232 may be positioned to first engage the earth formation during drilling operations to form the wellbore. The angles of the cutting surface 218 and the transition surfaces 222, 228 relative to the longitudinal centerline 230, and the sizes of the transition surfaces 222, 228 may be customized as desired to achieve a cutting edge 232 exhibiting a desired shape and/or size. In the embodiment shown in FIG. 12, the cutting edge 232 follows an outer boundary of a star shape with substantially flat point edges, and arcuate side edges between the flat point edges.

The shapes, angles, and relative dimensions of the cutting surface 218, the first transition surface 222, and/or the second transition surface 228 contemplated in this disclosure may be designed to achieve a desired aggressiveness of the cutting edge 232 of the cutting element 200, while also minimizing maximum (peak) stresses on the cutting table 210 by reducing point loading on the cutting table 210. In addition, the shapes, angles, and relative dimensions of the surfaces 218, 222, 228 may reduce the risk of torsional overloading in drilling applications. Minimizing the peak tensile stresses and/or the risk of torsional overloading on the cutting table 210 may improve wear resistance and longevity of the cutting element 200, and may also enhance drilling efficiency in certain earth formations.

The sizes of the first surface 216, the cutting surface 218, the first transition surface 222, and the second transition surface 228 may be selected such that each surface 216, 218, 222, and 228 occupies a certain percentage of an end surface area of the cutting table 210. The end surface area of the cutting table 210 may be the sum of the surface areas of the first surface 216, the cutting surface 218, the first transition surface 222, and the second transition surface 228. For example, the actual surface area of angled and/or arcuate surfaces may be included for the end surface area, rather than a projected surface area (e.g., in the X-Y plane).

Similar to the cutting table 110, the surface area occupied by any of the first surface 216, the cutting surface 218, the first transition surface 222, and the second transition surface 228 of the cutting table 210 may be larger, substantially the same size as, or smaller than any other of the first surface 216, the cutting surface 218, the first transition surface 222, and/or the second transition surface 228. For example, as shown in the embodiment illustrated in FIGS. 11 and 12, the first surface 216 occupies about 60% of the end surface area of the cutting table 210, the cutting surface 218 occupies about 25% of the end surface area of the cutting table 210, the first transition surface 222 (e.g., the collective surface area of the discrete sections of the first transition surface 222) occupies about 10% of the end surface area of the cutting table 210, and the second transition surface 228 (e.g., the collective surface area of the discrete sections of the first transition surface 222) occupies about 5% of the end surface area of the cutting table 210.

In addition, the first transition surface 222 (e.g., sections of the first transition surface 222) may be substantially planar or curved (e.g., concave, convex, etc.) along a length L of the first transition surface 222, where the length L is defined as a distance from a maximum distance from a first edge 234 at one end of the first transition surface 222 to a second edge 236 at another, opposite end of the first transition surface 222. In embodiments in which the first transition surface 222 includes multiple discrete sections (shown in FIGS. 11 and 12), the length L of each section of the first transition surface 222 is defined as a maximum distance from a first edge 234 at an end of a section of the first transition surface 222 to a second edge 236 at an opposite end of the section of the first transition surface 222.

Figure 13:
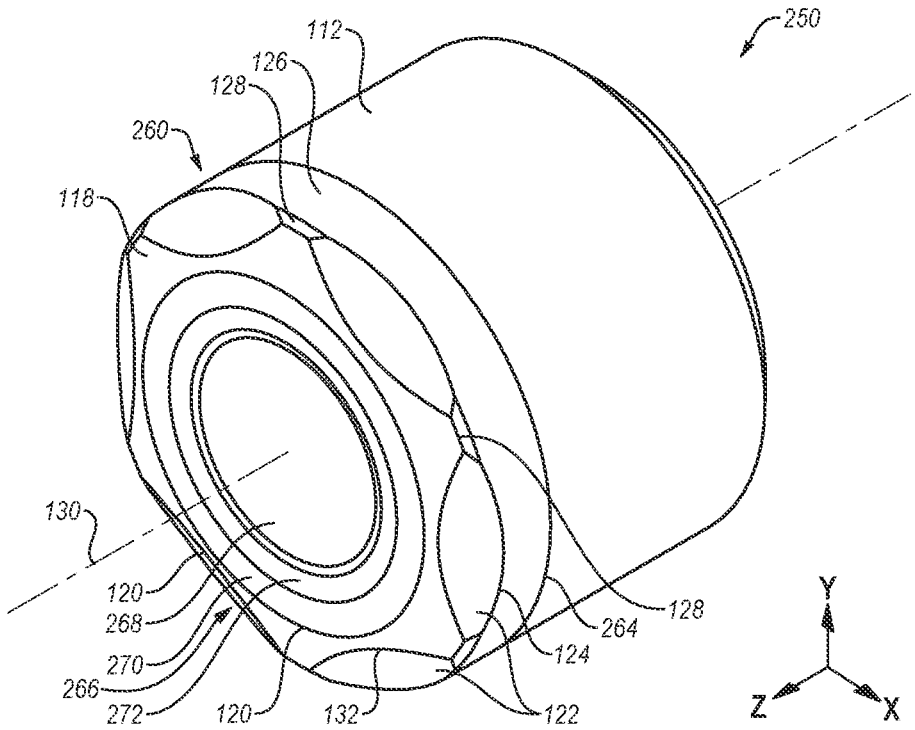
FIGS. 13and 14 are a perspective view (FIG. 13) and a side view (FIG. 14) of another cutting element, in accordance with embodiments of this disclosure.
Figure 14:
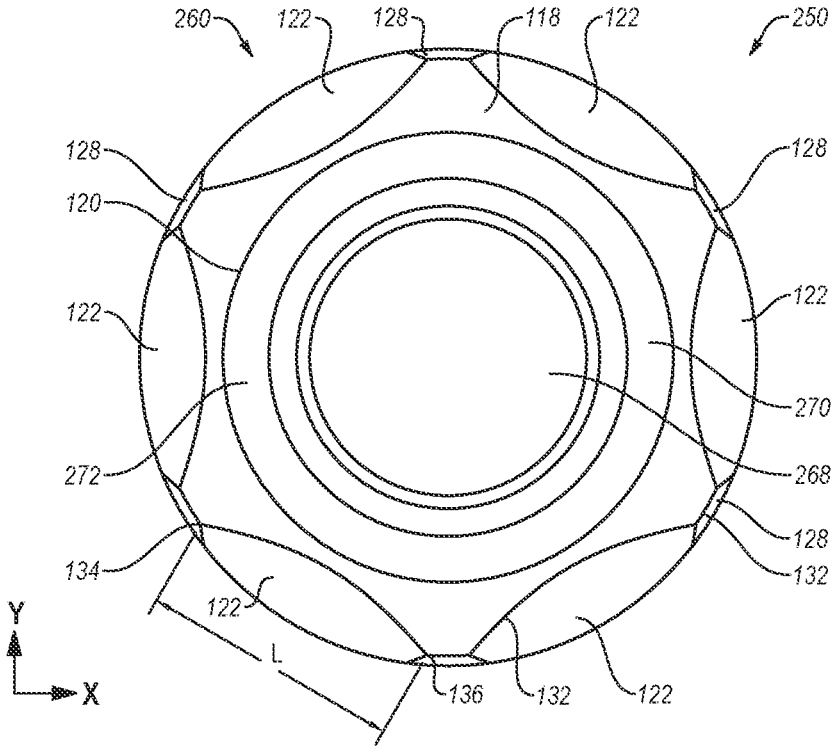

FIGS. 13 and 14 are a perspective view (FIG. 13) and a top view (FIG. 14) of another cutting element 250 in accordance with embodiments of this disclosure. The cutting element 250 may be similar to the cutting element 100 (FIG. 1). For example, the cutting element 250 includes a cutting table 260 that may be similar to the cutting table 110. The cutting table 260 may include a polycrystalline superabrasive material, such as, for example, polycrystalline diamond or cubic boron nitride. Similar to the cutting table 110, the cutting table 260 may be secured to an end of the substrate 112, forming an interface 264 between the cutting table 260 and the substrate 112.

In addition, the cutting table 260 may also include a first surface 216 and the cutting surface 118 arranged around at least a portion of the outer boundary 120 of a first surface 216. The cutting table 260 may further include the first transition surface 122 extending between the cutting surface 118 and the outer lateral edge 124 of the lateral surface 126 of the cutting table 260, and the second transition surface 128 between the cutting surface 118 and the outer lateral edge 124.

The first surface 266 may include at least one first section 268 and a second section 270 connected by transition section 272. For example, one or more sections of the cutting table 260 (e.g., the first section 268) within the outer boundary 120 may be recessed relative to one or more additional sections of the cutting table 260 (e.g., the second section 270).

The first section 268, the second section 270, and/or the transition section 272 of the first surface 266 may exhibit any desired shape and/or size. In some embodiments, as shown in FIGS. 13 and 14, the first section 268 may be a central recessed section, and the second section 270 surrounds the first section 268. In additional embodiments, the second section 270 may be recessed and the first section 268 may extend outward (e.g., in the Z-direction) relative to the second section 270. In further embodiments, the first section 268 may include multiple recesses arranged in a pattern laterally across the cutting table (e.g., in a line, an array, and/or a shape, such as a circle, triangle, square, etc.).

The sizes of the first surface 266, the cutting surface 118, the first transition surface 122, and the second transition surface 128 may be selected such that each surface 266, 118, 122, and 128 occupies a certain percentage of an end surface area of the cutting table 110. The end surface area of the cutting table 110 may be the sum of the surface areas of the first surface 116, the cutting surface 118, the first transition surface 122, and the second transition surface 128. For example, the actual surface area of angled and/or arcuate surfaces may be included for the end surface area, rather than a projected surface area (e.g., in the X-Y plane).

The first section 268, the second section 270, and the transition section 272 may each occupy a desired surface area of the cutting table 260 and/or the first surface 266. For example, the first section 268, the section 270, and the transition section 272 may each occupy from about 10% to about 90% of the surface area of the first surface 266. As a non-limiting example, and as shown in FIGS. 13 and 14, the first section 268 may occupy about 50% of the surface area of the first surface 266, the second section 270 may occupy about 30% of the surface area of the first surface 266, and the transition section 272 may occupy about 20% of the surface area of the first surface 266.

In addition, the first section 268, the second section 270, and/or the transition section 272 may be substantially planar or curved (e.g., concave, convex, etc.). In some embodiments, the transition section 272 may be oriented substantially vertically (e.g., along the Z-axis). In additional embodiments, the transition section 272 may be beveled, chamfered, rounded, etc., to further reduce localized stressed on the cutting table 260.

Where logically possible, the features of the cutting elements shown and described in connection with FIGS. 1-14 may be combined with one another. For example, although the first surface 266 is only shown as subdivided into the first section 268, the second section 270, and the transition section 272 in FIGS. 13 and 14, each of the first surfaces 116, 166, 216 may include these sections and/or recesses shown and described with reference to FIGS. 13 and 14.

Figure 15:
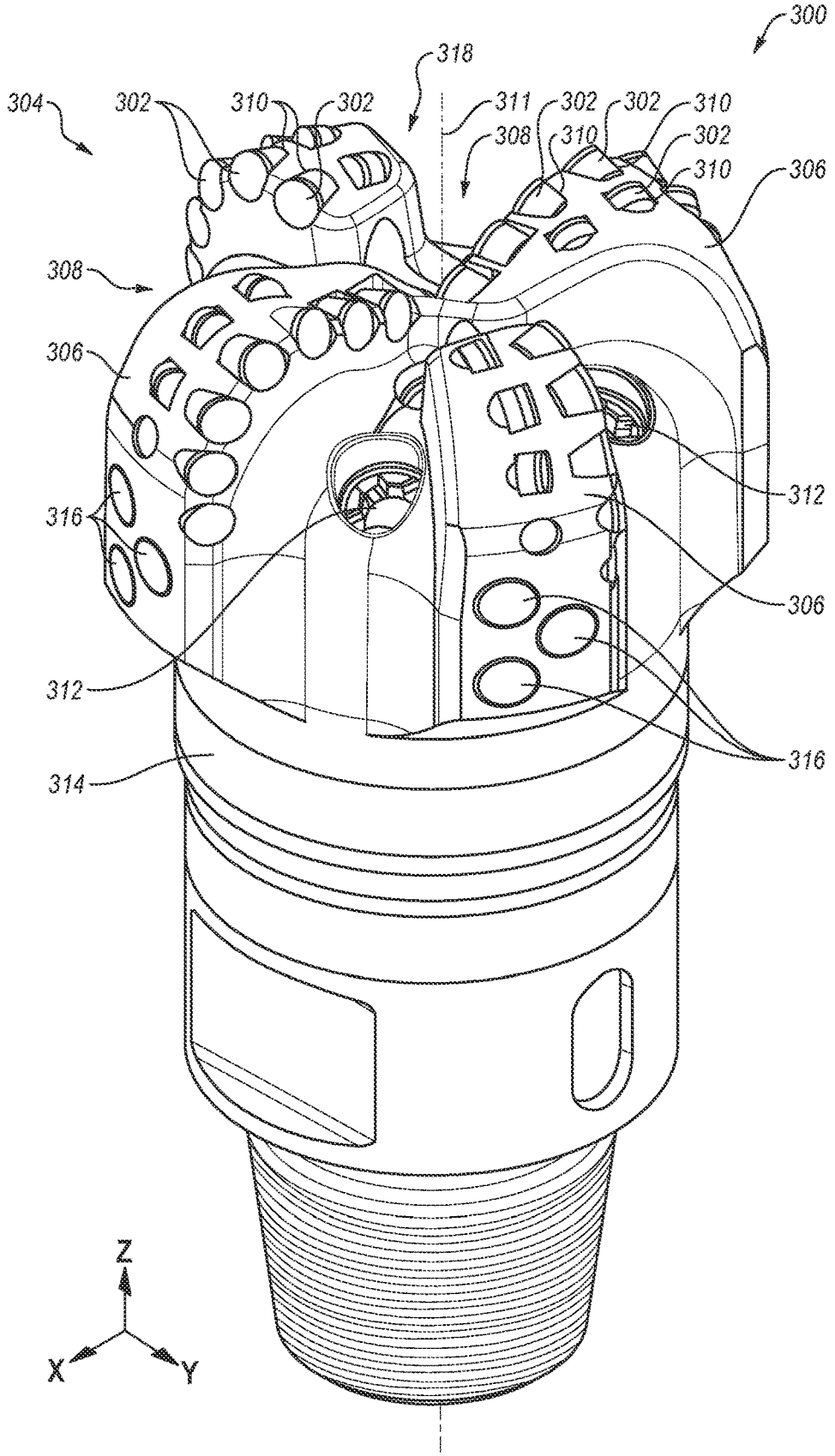
FIG. 15 is a perspective view of an earth-boring tool that includes one or more of the cutting elements of FIGS. 1-14, in accordance with embodiments of this disclosure.

FIG. 15 is a perspective view of an earth-boring tool 300 including one or more cutting elements 302, which may be configured as any of the embodiments shown in connection with FIGS. 1-14, or any possible combination of their features, as described above. For the sake of simplicity, the cutting elements 302 have been illustrated as having planar cutting faces, but at least one of the cutting elements 302, up to all of the cutting elements 302, may have the complex geometries described above. The earth-boring tool 300 may include a bit body 304 to which the cutting element(s) 302 may be secured. The earth-boring tool 300 specifically depicted in FIG. 15 is configured as a fixed-cutter earth-boring drill bit, including blades 306 projecting outward from a remainder of the bit body 304 and defining junk slots 308 between rotationally adjacent blades 306. In such an embodiment, the cutting element(s) 302 may be secured (e.g., brazed, bonded, etc.) at least partially within cutting element pockets 310 extending into one or more of the blades 306 (e.g., proximate the rotationally leading portions of the blades 306 as primary cutting elements 302, rotationally following those portions as backup cutting elements 302, or both). In operation, the earth-boring tool 300 may be rotated about a central longitudinal axis 311 of the earth-boring tool 300 such that the cutting elements 302 secured to rotationally leading portions of the blades 306 engage and remove material from the earth formation.

The cutting elements 302 as described herein may be bonded to and used on other types of earth-boring tools, including, for example, roller cone drill bits, percussion bits, core bits, eccentric bits, bi-center bits, reamers, expandable reamers, mills, hybrid bits, and other drilling bits and tools known in the art.

Forming the earth-boring tool 300 involves processing a variety of raw materials, such as, for example, graphite, silicon carbide, diamond material, carbon steel, tungsten carbide, nitrile, silicones and rubbers, and stainless steel. The raw materials may be processed into components, such as a bit body 304, nozzles 312, a shank 314, the cutting elements 302, and the superabrasive inserts 316 (e.g., thermally stable polycrystalline diamond inserts, or TSPs) that are combined to form the resulting earth-boring tool 300.

In some embodiments, the bit body 304 may be formed from a particle-matrix composite material. For example, raw materials, such as graphite may be machined to form a crown mold for the bit body 304. The crown mold may include the general geometry of the bit body 304 to be formed from the crown mold, such as recesses for the blades 306. Graphite may also be used to form displacements in the shapes of cutting elements 302, and nozzles 312 that may be placed into the mold before a casting process to form pockets and openings within the resulting bit body 304. Superabrasive inserts 316 may be placed on the interior of the crown mold and infiltrated into the bit body 304 as described below.

The earth-boring tool 300 may include nozzles 312 that provide a continuous fluid passageway from the shank 314 to the face region 318 of the earth-boring tool 300. For example, the shank 314 may include a large central fluid passageway that extends partially through the bit body 304, and then the central fluid passageway branches into smaller channels that extend to the nozzles 312.

The bit body 304 of the earth-boring tool 300 is typically secured to the shank 314, which may be a hardened steel shank having an American Petroleum Institute (API) thread connection for attaching the earth-boring tool 300 to a drill string. The drill string includes tubular pipe and equipment segments coupled end to end between the drill bit and other drilling equipment at the surface, as shown in FIG. 16.

Figure 16:
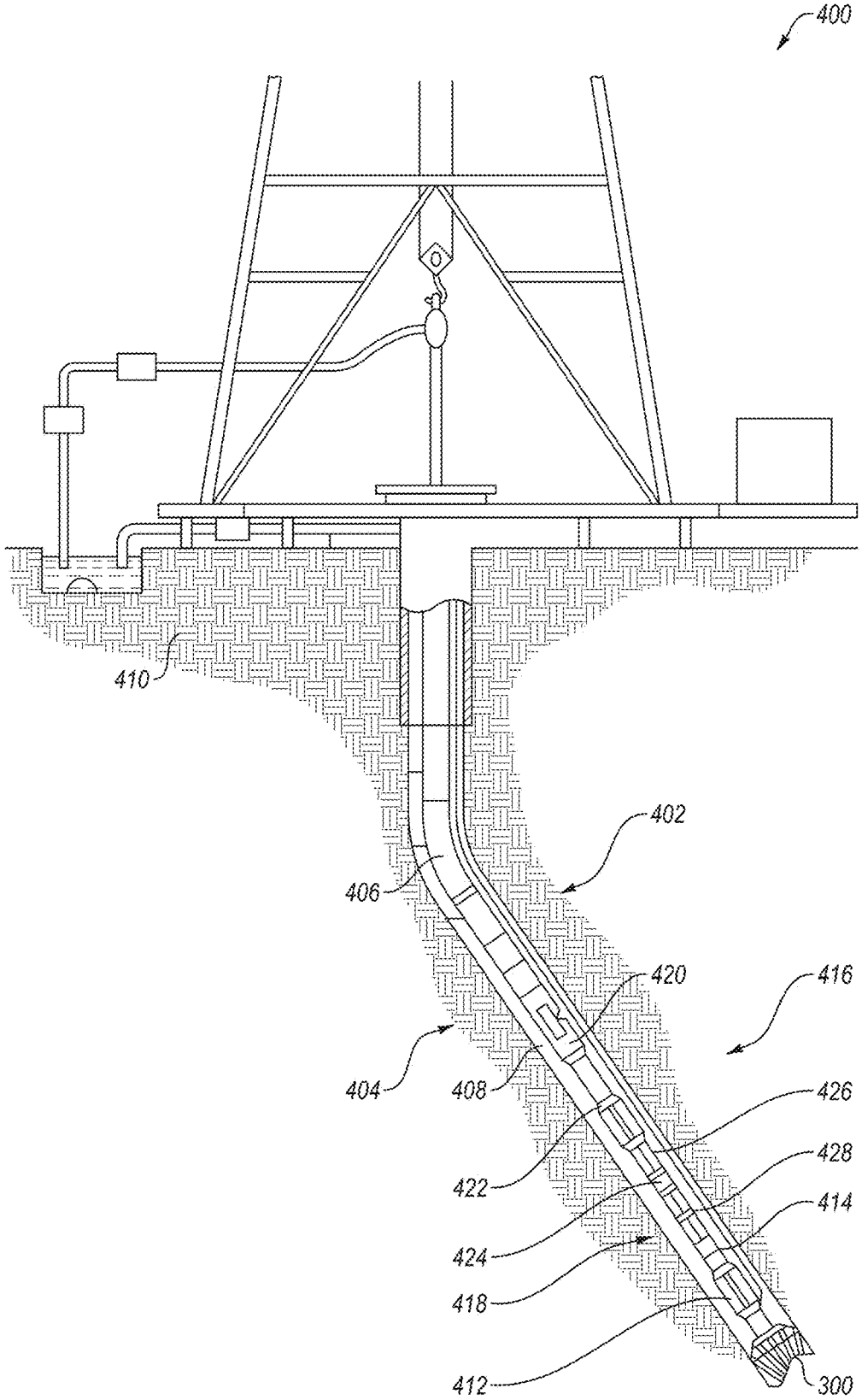
FIG. 16 is a simplified partial cross-sectional view of an earth-boring system that includes the earth-boring tool of FIG. 15, in accordance with embodiments of this disclosure.

FIG. 16 is a simplified partial cross-sectional view of an earth-boring system 400. An earth-boring system 400 may include a drill string 402 made up of drill string components 404 that includes sections of drill pipe 406 coupled together end-to-end and inserted into a wellbore 408. The wellbore 408 may be formed and/or enlarged (e.g., elongated) by rotational movement of the earth-boring tool 300 engaging a formation 410 at a downhole end of the drill string 402. For example, the earth-boring tool 300 may rotate by circulating drilling fluid through a motor 412 and/or by a drilling rig (e.g., a top drive rig or a Kelly rig) rotating the drill string 402. As drilling progresses, the wellbore 408 elongates, and additional sections of drill pipe 406 may be sequentially coupled to an uphole end of the drill string 402.

The drill string 402 may include multiple drill string components 404, such as sections of drill pipe 406, one or more drill collars 414, and a bottom-hole assembly (BHA) 416. The BHA 416 is generally located at the downhole end of the drill string 402. The BHA 416 may include downhole tools 418, such as a measuring-while-drilling (MWD) subassembly, a logging-while-drilling (LWD) subassembly, as a motor 412 (e.g., mud motor), a second earth-boring tool 420 (e.g., a reamer that includes the cutting elements 100, 150, 200, 250, and/or 302), and/or stabilizers 422, and the earth-boring tool 300 (e.g., a drill bit). The BHA 416 may also include electronics, such as sensors 424, modules 426, and/or tool control components 428. The tool control components 428 may be configured to control an operational aspect of the earth-boring tool 300. For example, the tool control components 428 may include a steering component configured to change an angle of the earth-boring tool 300 with respect to the drill string 402 changing a direction of advancement of the drill string 402. The tool control components 428 may be configured to receive instructions from an operator at the surface and perform actions based on the instructions. In some embodiments, control instructions may be derived downhole within the tool control components 428, such as in a closed-loop system.

The modified geometries of the embodiments described above are expected to mitigate thumbnail cracking, as well as tensile and/or tangential overload when compared to geometries for other cutting elements known to the inventors. Furthermore, modified geometries of the embodiments described above contain angled faces to maintain cutting efficiency while allowing for increased durability. The modified geometries of the embodiments described above will allow for greater use in higher weight and torque drilling environments.

In addition, the modified geometries of the embodiments described above may be easier to manufacture compared to other cutting elements that include cutting tables with complex geometry that generally require laser-cutting portions of the cutting table. For example, the surfaces of embodiments described above may be easier to grind and/or polish because of their proximity to the periphery of the cutting table, making modifications easier than previous designs. In addition, the surfaces of cutting tables of embodiments described above can also be laser-cut similar to other complex geometry cutting tables.

Accordingly, it would be desirable to have cutting elements, earth-boring tools (e.g., rotary drill bits), and methods of forming and using the cutting elements and the earth-boring tools facilitating enhanced cutting efficiency and prolonged operational life during drilling operations as compared to conventional cutting elements, conventional earth-boring tools, and conventional methods of forming and using the conventional cutting elements and the conventional earth-boring tools.

While embodiments of the disclosure have been described and illustrated herein with respect to specific discrete cutting element structures, earth-boring tools and methods, those of ordinary skill in the art will recognize and appreciate that features and elements from different embodiments may be combined to arrive at further, additional cutting elements structures, earth-boring tools and methods as contemplated by the inventors. Further, the metes and bounds of inventions encompassed by the various embodiments of the disclosure are limited only by the claims appended hereto and legal equivalents.

What is claimed is:

1. A cutting element, comprising:

a substrate; and a cutting table secured to the substrate at an interface, the cutting table comprising a superabrasive material, the cutting table comprising:

a first surface including an outer boundary;

a cutting surface at least substantially surrounding the outer boundary of the first surface, the cutting surface angled relative to a longitudinal centerline of the cutting table;

a plurality of first transition surfaces between the cutting surface and an outer lateral edge of the cutting table, each of the plurality of first transition surfaces oriented at a first angle relative to the longitudinal centerline of the cutting table;

a plurality of second transition surfaces between the cutting surface and the outer lateral edge of the cutting table, each of the plurality of second transition surfaces oriented at a second angle, different than the first angle, relative to the longitudinal centerline of the cutting table, the plurality of second transition surfaces positioned in an alternating circumferential sequence with the plurality of first transition surfaces; and a cutting edge defined by an interface between the cutting surface and each of: the plurality of first transition surfaces; and the plurality of second transition surfaces.

2. The cutting element of claim 1, wherein each of the plurality of first transition surfaces is larger than each of the plurality of second transition surfaces.

3. The cutting element of claim 1, wherein the plurality of first transition surfaces occupies a surface area within a range of from about 5% and about 20% of a total surface area of a cutting face of the cutting element.

4. The cutting element of claim 1, wherein the first surface occupies a surface area within a range of from about 20% to about 80% of a total surface area of a cutting face of the cutting element.

5. The cutting element of claim 1, wherein a central portion of the cutting table is recessed relative to a surrounding portion of the cutting table such that a first section of the first surface is recessed relative to a second section of the first surface.

6. The cutting element of claim 1, wherein each of the plurality of first transition surfaces exhibits a concave surface profile from a first edge to a second edge thereof, the second edge opposite the first edge.

7. The cutting element of claim 1, wherein the first surface is substantially planar.

8. An earth-boring tool, comprising:

a bit body;

a blade extending radially outward from and further extending in a direction parallel to a central longitudinal axis of the bit body, the blade comprising a rotationally leading portion; and a cutting element secured to the blade proximate the rotationally leading portion of the blade, the cutting element comprising:

a substrate; and a cutting table secured to the substrate at an interface, the cutting table comprising a superabrasive material, the cutting table comprising:

a first surface including an outer boundary;

a cutting surface at least substantially surrounding the outer boundary of the first surface, the cutting surface oriented at a first angle relative to a longitudinal centerline of the cutting table;

a plurality of first transition surfaces between the cutting surface and an outer lateral edge of the cutting table, each of the plurality of first transition surfaces oriented at a second angle relative to the longitudinal centerline of the cutting table;

a plurality of second transition surfaces between the cutting surface and the outer lateral edge of the cutting table, each of the plurality of second transition surfaces oriented at a third angle relative to the longitudinal centerline of the cutting table, the third angle different than the second angle, the plurality of second transition surfaces positioned in an alternating circumferential sequence with the plurality of first transition surfaces; and a cutting edge defined by an interface between the cutting surface and each of: the plurality of first transition surfaces; and the plurality of second transition surfaces.

9. The earth-boring tool of claim 8, wherein the substrate of the cutting element is at least partially disposed within a cutting element pocket of the bit body.

10. The earth-boring tool of claim 8, wherein the first angle is greater than the second angle, and the second angle is greater than the third angle.

11. The earth-boring tool of claim 8, wherein the second angle is greater than the third angle.

12. The earth-boring tool of claim 8, wherein the first angle is within a range of from about 60 degrees to about 80 degrees.

13. The earth-boring tool of claim 8, wherein the second angle is within a range of from about 45 degrees to about 75 degrees.

14. The earth-boring tool of claim 8, wherein the third angle is within a range of from about 35 degrees to about 55 degrees.

15. A method of forming an earth-boring tool, the method comprising:

securing a cutting element within a pocket of an unfinished earth-boring tool, the cutting element comprising a cutting table, comprising:

a first surface;

a cutting surface surrounding the first surface and angled relative to a central longitudinal axis of the cutting table;

a plurality of first transition surfaces and a plurality of second transition surfaces positioned in an alternating circumferential sequence, the plurality of first transition surfaces angled differently relative to the central longitudinal axis of the cutting table than the plurality of second transition surfaces; and a cutting edge defined by an interface between the cutting surface and each of: the plurality of first transition surfaces; and the plurality of second transition surfaces.

16. The method claim 15, further comprising grinding the first surface to form a uniform chamfered section angled within a range of from about 65 degrees to about 75 degrees relative to the central longitudinal axis of the cutting table.

* * * * *